US007128722B2

(12) United States Patent
Lev et al.

(10) Patent No.: US 7,128,722 B2
(45) Date of Patent: Oct. 31, 2006

(54) PERCUSSIVE MASSAGER WITH VARIABLE NODE SPACING

(75) Inventors: Mordechai Lev, West Bloomfield, MI (US); Roman S. Ferber, West Bloomfield, MI (US); Charles Huang, Taipei (TW)

(73) Assignee: Homedics, Inc., Commerce Township, MI (US)

( * ) Notice: Subject to any disclaimer, the term of this patent is extended or adjusted under 35 U.S.C. 154(b) by 360 days.

(21) Appl. No.: 10/495,738

(22) PCT Filed: Mar. 17, 2003

(86) PCT No.: PCT/US03/08284

§ 371 (c)(1),
(2), (4) Date: May 17, 2004

(87) PCT Pub. No.: WO03/082179

PCT Pub. Date: Oct. 9, 2003

(65) Prior Publication Data

US 2005/0010141 A1 Jan. 13, 2005

(51) Int. Cl.
*A61H 23/02* (2006.01)

(52) U.S. Cl. ..... 601/108; 601/111

(58) Field of Classification Search ..... 601/107, 601/108, 110, 111, 129–131, 134–135
See application file for complete search history.

(56) References Cited

U.S. PATENT DOCUMENTS 775,813 A 11/1904 Fornander
1,098,337 A 5/1914 Soukup
1,269,803 A 6/1918 Elmen et al.
1,339,179 A 5/1920 Elmen
1,377,140 A 5/1921 North
1,657,765 A 1/1928 Pasque
1,888,510 A 11/1932 Mashek
2,138,815 A 12/1938 Eberly
2,466,659 A 4/1949 Korpela
2,964,037 A 12/1960 Johnston
3,094,119 A 6/1963 Avedissian
3,374,784 A 3/1968 Brent et al.

(Continued)

FOREIGN PATENT DOCUMENTS

EP 0001833 5/1979

(Continued)

OTHER PUBLICATIONS

Brookstone "15 Speed Percussion Massager" booklet with 9 sheets of photographs of the 15 Speed Percussion Massager, © 1999.

*Primary Examiner*—Michael A. Brown
(74) *Attorney, Agent, or Firm*—Brooks Kushman P.C.

(57) ABSTRACT

A percussive massager is provided having a housing supporting a motor having an output shaft rotatably driven thereby. At least one positioning member is movably connected to a percussion arm which is attached to the housing and operably connected to the motor output shaft. At least two massage nodes are operably connected to the percussion arm, one of which being attached to the positioning member, to form a massage surface and move toward and away from the housing to provide a percussive massage effect. A rotary mechanism is rotatable with respect to the percussion arm and drives the positioning member toward and away from a central region of the housing. An ancillary transmission has an output and an input for operably imparting rotation to the rotary mechanism such that the spacing of the massage nodes progressively increases and decreases.

55 Claims, 15 Drawing Sheets

U.S. PATENT DOCUMENTS

| | | | |
|---|---|---|---|
| 3,467,080 | A | 9/1969 | McNair |
| 3,536,064 | A | 10/1970 | Kuroda et al. |
| 3,548,811 | A | 12/1970 | Wilson |
| 3,626,934 | A | 12/1971 | Andis |
| 3,672,355 | A | 6/1972 | Ogawa et al. |
| 3,802,423 | A | 4/1974 | Pfaendler |
| 3,881,470 | A | 5/1975 | Glore |
| 4,025,809 | A | 5/1977 | Teranishi |
| 4,079,733 | A | 3/1978 | Denton et al. |
| 4,088,128 | A | 5/1978 | Mabuchi |
| 4,098,266 | A | 7/1978 | Muchisky et al. |
| 4,149,530 | A | 4/1979 | Gow |
| 4,150,668 | A | 4/1979 | Johnston |
| 4,414,963 | A | 11/1983 | Kunz |
| 4,512,339 | A | 4/1985 | McShirley |
| 4,718,408 | A | 1/1988 | Barreiro |
| 4,730,605 | A | 3/1988 | Noble et al. |
| D299,863 | S | 2/1989 | Noble et al. |
| 4,827,914 | A | 5/1989 | Kamazawa |
| 5,088,474 | A | 2/1992 | Mabuchi et al. |
| 5,159,922 | A | 11/1992 | Mabuchi et al. |
| 5,361,437 | A | 11/1994 | Zhu et al. |
| 5,447,491 | A | 9/1995 | Bellandi |
| 5,716,332 | A | 2/1998 | Noble |
| 5,772,615 | A | 6/1998 | Elder et al. |
| 5,803,916 | A | 9/1998 | Kuznets et al. |
| 5,868,689 | A | 2/1999 | Faroky et al. |
| 5,923,107 | A | 7/1999 | Franck |
| 5,935,089 | A | 8/1999 | Shimizu |
| D415,838 | S | 10/1999 | Noble |
| 6,033,372 | A | 3/2000 | Tarbet et al. |
| 6,102,875 | A | 8/2000 | Jones |
| 6,102,876 | A | 8/2000 | Winger |
| 6,165,145 | A | 12/2000 | Noble |
| 6,224,563 | B1 | 5/2001 | Nonoue et al. |
| 6,432,072 | B1 | 8/2002 | Harris et al. |
| 6,500,135 | B1 | 12/2002 | Huang |

FOREIGN PATENT DOCUMENTS

| | | |
|---|---|---|
| GB | 498228 | 12/1938 |
| GB | 2 267 440 A | 12/1993 |

PERCUSSIVE MASSAGER WITH VARIABLE NODE SPACING

CROSS-REFERENCE TO RELATED APPLICATIONS

This application claims priority to U.S. application Ser. No. 10/108,871, filed Mar. 28, 2002.

BACKGROUND OF THE INVENTION

1. Field of the Invention

This invention relates to a massager which exerts a percussive massage effect with nodes having variable spacing.

2. Background Art

Power operated massagers are often used to treat muscle tension and fatigue. Massagers that exert a percussive effect on the body are preferred over massagers which generate a rubbing action, since the latter type of massager can cause irritation or other discomfort to the recipient.

Application Ser. No. 09/475,810, filed by same assignee on Dec. 30, 1999, published Oct. 4, 2001 as No. US2001/0027280A1 discloses a percussive massager and is incorporated by reference herein. The massager includes a motor having an output shaft extending from either side thereof, the motor being affixed within the housing by a motor support unit. A rocker arm is pivotally mounted to the motor support unit. A pair of connecting rods, each mounted to either end of the output shaft, are also mounted to the rocker arm. A pair of spaced-apart nodes are mounted to the rocker arm wherein the motor drives the rocker arm in an asynchronous manner thereby imparting a percussive massage effect to the massage nodes.

Prior to the percussive massager of application Ser. No. 09/475,810, prior art percussive massagers typically included a single eccentrically driven connecting rod for oscillating a centrally pivoted rocker arm carrying a pair of massage nodes to achieve a single connecting rod design required that the rocker arm have a substantial cross-section to accommodate the bending load resulting from a single input. Additionally, the single input design required the connecting rod to be alternatively loaded in compression and tension making it difficult to elastically attach the connecting rod to the rocker arm. The pair of connecting rods asynchronously driving the rocker arm overcame these limitations.

However, the prior art percussive massagers do not offer any flexibility or adjustment of the spacing of the massage nodes or formations without manual adjustment of the spacing. Accordingly, it is the goal of the present invention to provide a simple, low-cost and low-weight percussive massager providing variable spacing of the massage nodes or formations.

SUMMARY OF THE INVENTION

The percussive massager of the present invention includes a housing supporting a motor having an output shaft. A percussion arm is attached to the motor housing and is operably driven by the motor output shaft. At least one positioning member is movably connected to the percussion arm and at least two massage nodes are operably connected to the percussion arm, one of which is attached to the positioning member. The motor drives the percussion arm wherein the massage nodes are moved toward and away from the massage head portion thereby providing a percussive massage effect. A rotary mechanism, rotatable with respect to the percussion arm, is engaged with the positioning member to drive a portion of the positioning member toward and away from a central region of the massage head portion. An ancillary transmission imparts a reduced rotation from the motor output shaft to the rotary mechanism to progressively increase and decrease the spacing of the massage nodes.

DETAILED DESCRIPTION OF THE PREFERRED EMBODIMENT

Figure 1:
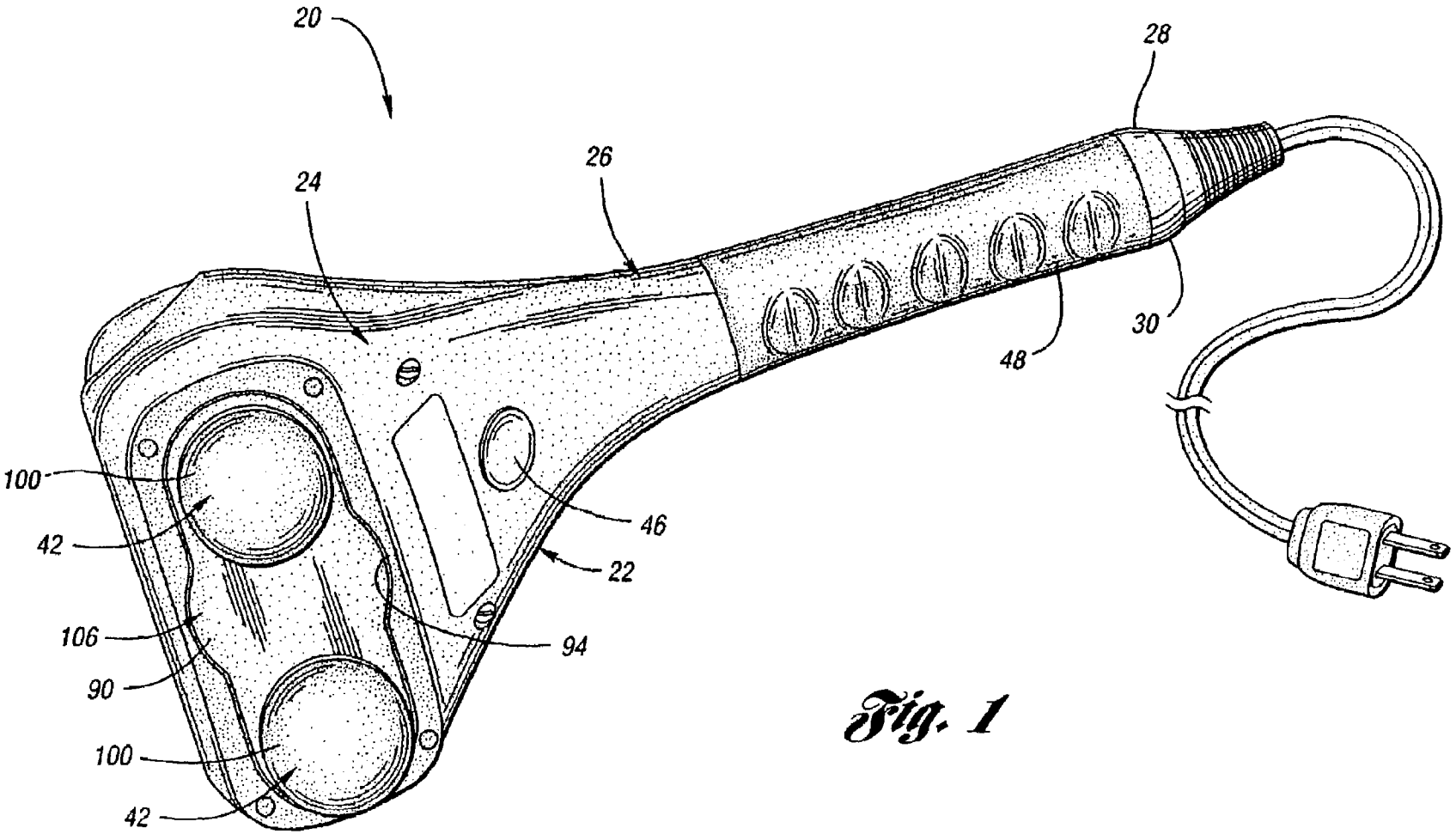
FIG. 1 is a bottom perspective view of a percussive body massager in accordance with the present invention.
Figure 2:
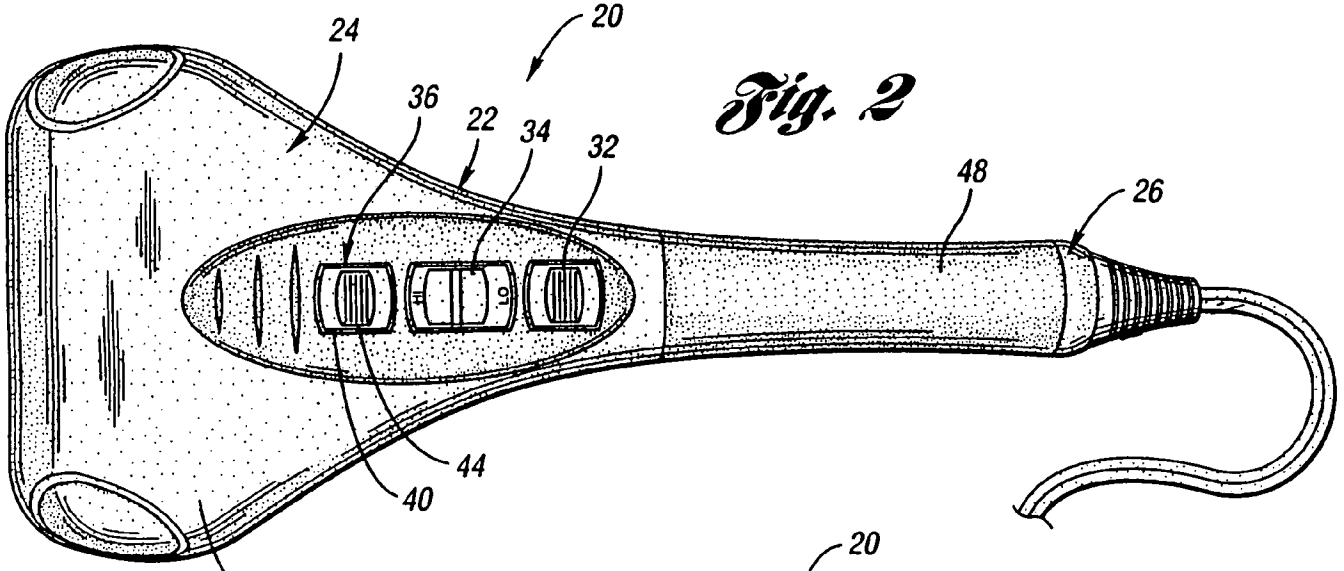
FIG. 2 is a top plan view of the percussive body massager of FIG. 1.
Figure 3:
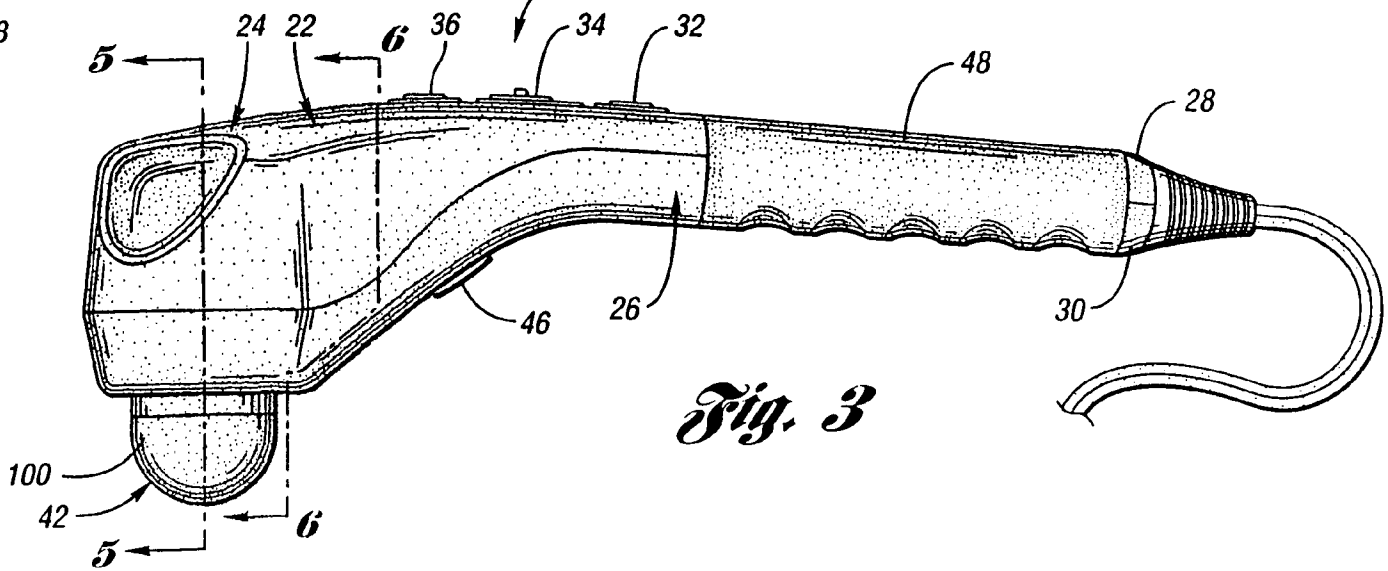
FIG. 3 is a side elevation view of the percussive body massager of FIG. 1.

Referring to FIGS. 1–3, an exemplary and preferred percussive body massager in accordance with the present invention is shown and indicated by reference numeral 20. Massager 20 is a hand held massager and comprises a housing 22 formed generally as two portions, a massage head 24 and a handle 26. Housing 22 is preferably constructed from a plastic material and is assembled from two parts, a top 28 and a bottom 30. Massager 20 is advantageously constructed to be light enough for a user to use it with only one hand if desired.

As shown in FIGS. 1–3, handle portion 26 is preferably elongate and extends perpendicularly from massage head 24. Handle 26 preferably contains slidable switches for a user's adjustment, as best shown in the top plan view of FIG. 2, which are located on housing top 28 for convenient user access and viewing. The switches include a power switch 32, a variable speed lever 34, and a variable spacing switch 36. The power switch 32 provides three options of use, massage, massage and heat, and off. The power switch 32 and variable speed lever 34 are electrically connected to a circuit board assembly 38 (best shown in FIG. 4*b*). Advantageously, variable speed lever 34 is not limited to discrete speed levels, but rather can be slidingly located at many different massage speeds to achieve the precise speed desired by the user. Massager 20 of the present invention is capable of providing a high-intensity massage of approximately 3,000 pulses per minute. To adjust the intensity of the massage, a user simply slides speed lever 34 in one direction for higher intensity or in the opposite direction for lower intensity. Of course, massager 20 can alternatively incorporate power and speed selection switches other than slidable type switches.

The variable spacing switch 36 can be slid to a first position 40 for continuously and progressively increasing and decreasing the spacing of massage nodes 42. This feature allows the user to enjoy both a percussive massage effect from the massage nodes 42 and a progressive variable massage contact surface provided by the increasing and decreasing spacing of the massage nodes 42. Alternatively, a user may slide the variable spacing switch 36 to a first position 40 until the massage nodes reach a spacing desired, and then slide the variable spacing lever 36 to a second position 44, turning off the variable spacing and thus maintaining a user-selected spacing of the massage nodes 42.

A variable spacing button 46 extends from a bottom part 30 of the massager housing 22. When pressed by a user, the variable spacing button 46 causes the spacing of the massage nodes 42 to progressively increase and decrease. Accordingly, the variable spacing button 46 is located intermediate to the massage head portion 24 and handle portion 26, thus allowing a user to easily operate the variable spacing button 46 with an index finger. The variable spacing button 46 may be pressed temporarily to achieve a user-selected spacing of the massage nodes 42 or the variable spacing button 46 may be engaged continuously manually or by way of a detent to achieve a continuous variable spacing of the massage nodes 42.

Still referring to FIGS. 1–3, handle 26 is designed to have a general arc, thereby facilitating the use of massager 20 by a user on his/her own back. In addition, handle 26 is also preferably contoured to facilitate a user's grasp and is provided with a foam cushion 48 to provide a user with an easy and comfortable grip.

Figure 4A:
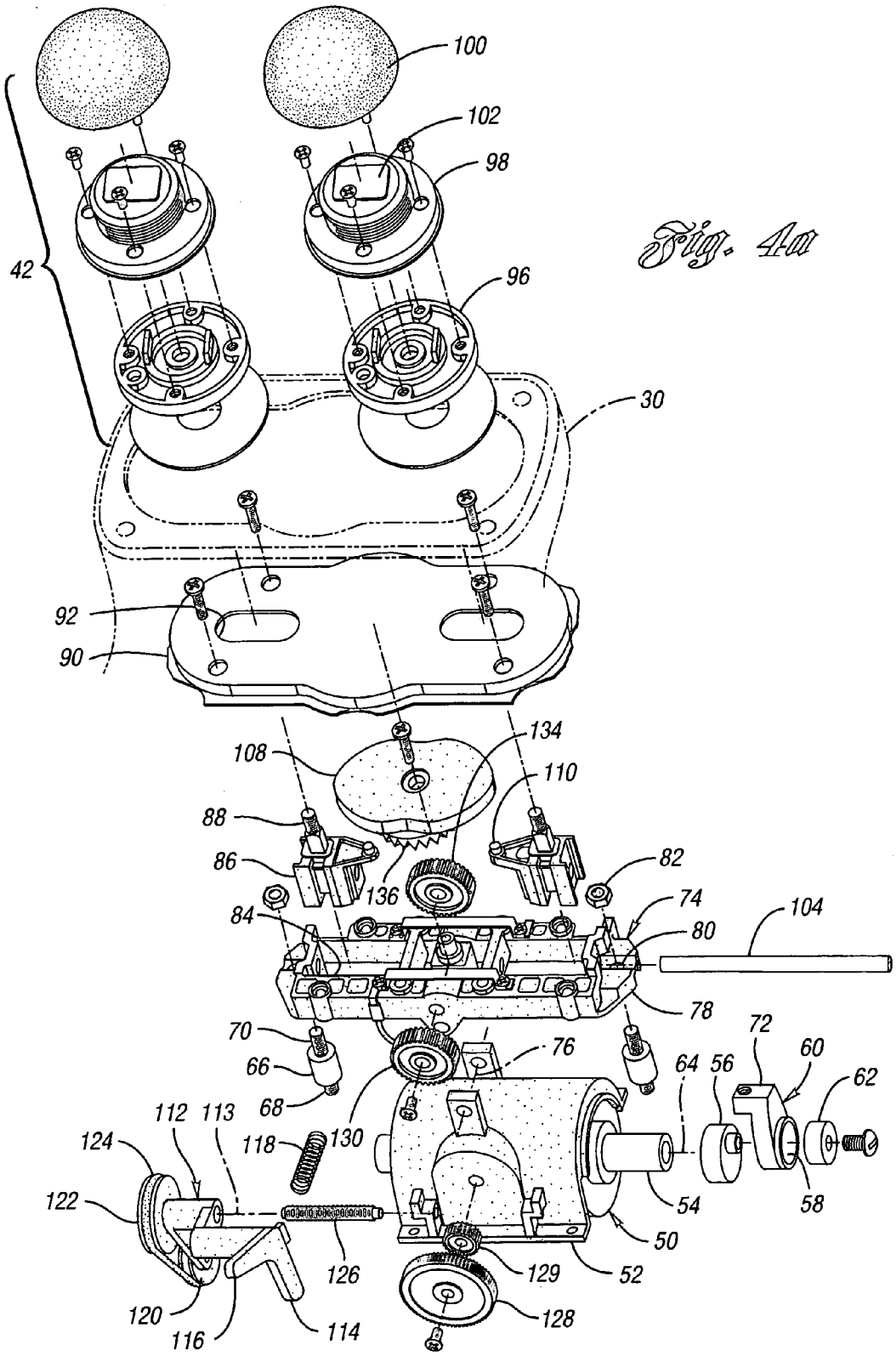
FIG. 4*a* is a portion of an exploded view of the percussive body massager of the present invention.
Figure 4B:
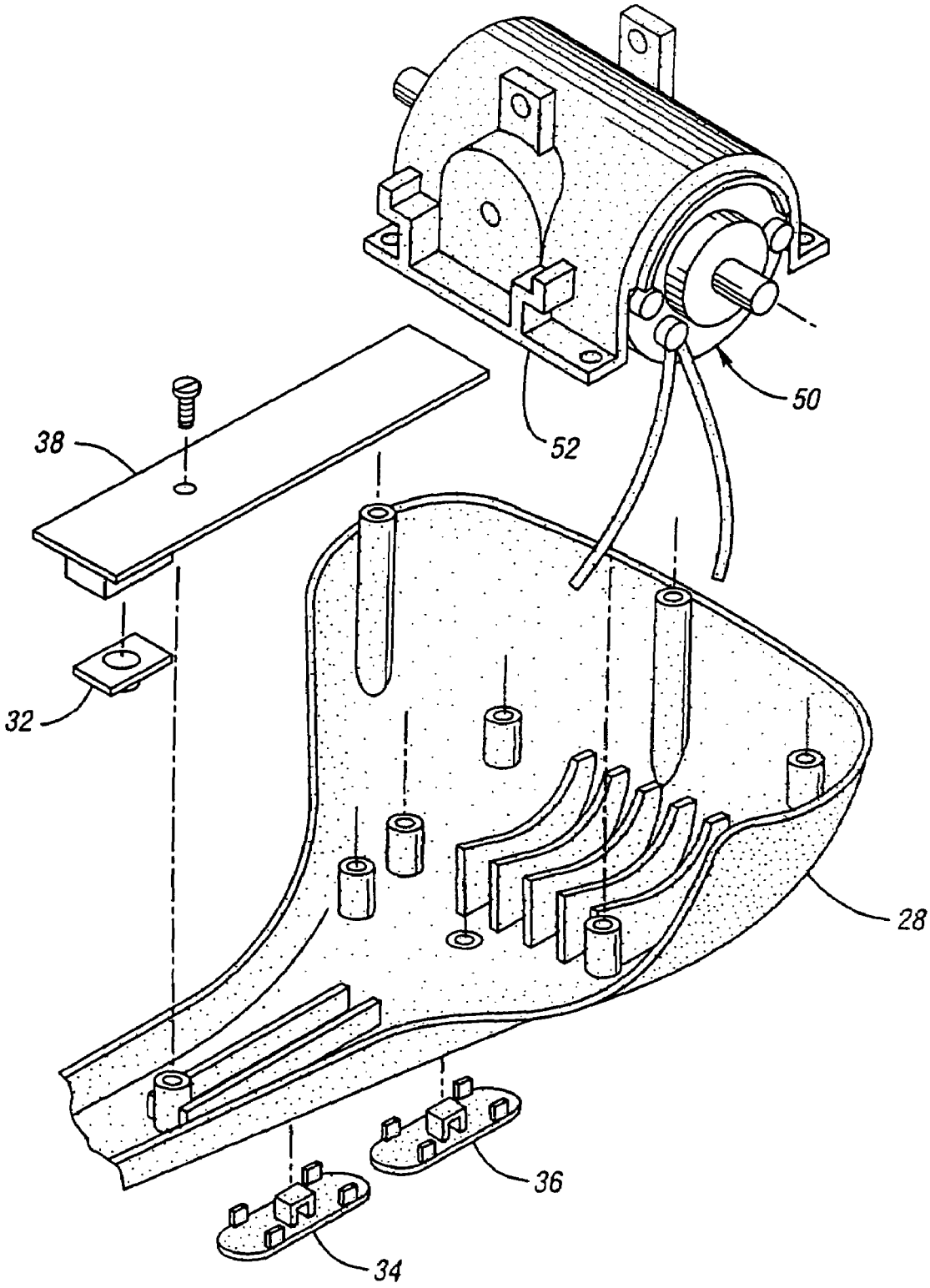
FIG. 4*b* is a remaining portion of the exploded view of FIG. 4*a;*
Figure 5:
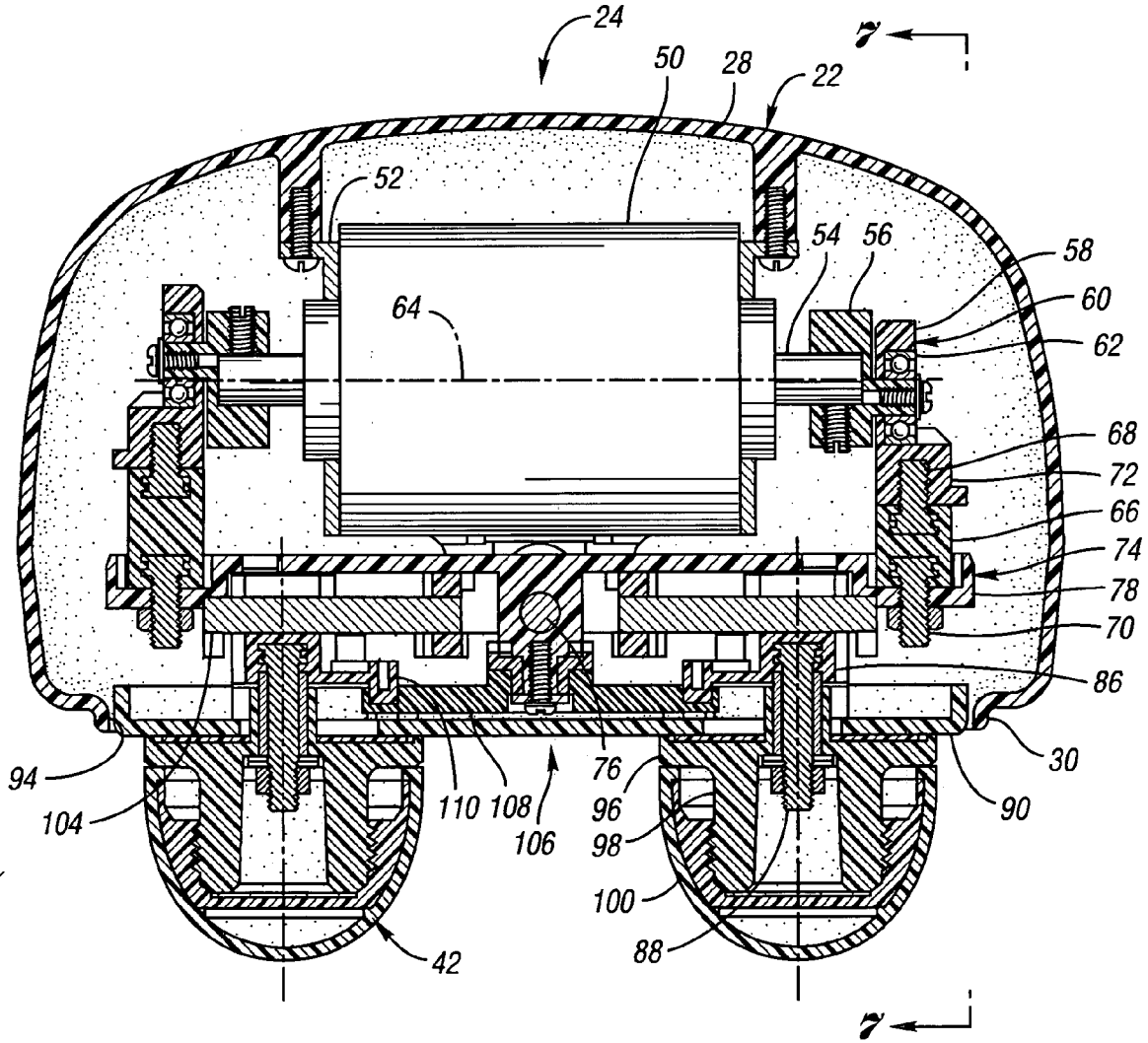
FIG. 5 is an end, cross-sectional view of the massage head portion of the percussive body massager taken along line 5—5 of FIG. 3.
Figure 6:
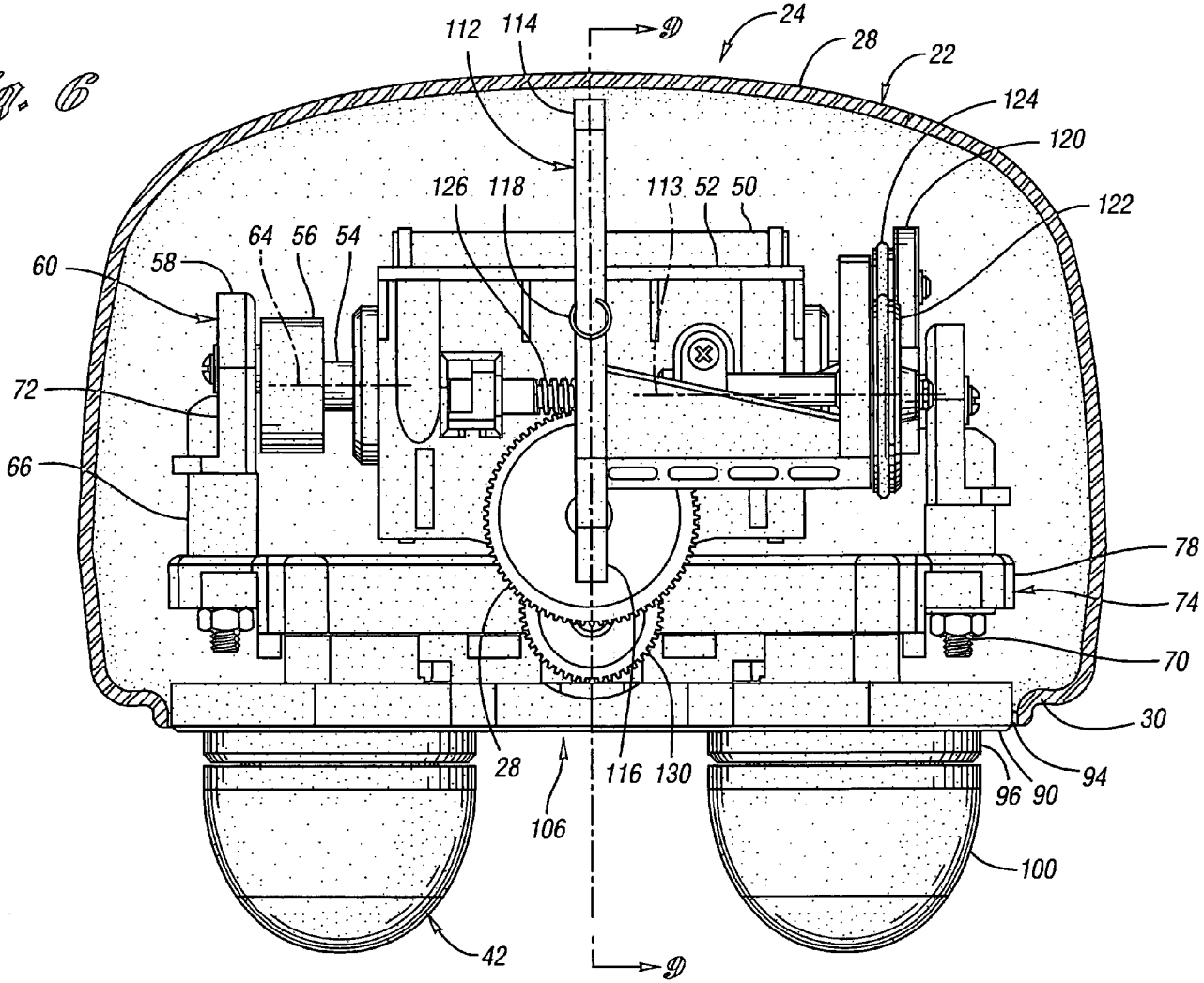
FIG. 6 is an end, cross-sectional view of the massage head portion of the percussive body massager taken along line 6—6 of FIG. 3.
Figure 7:
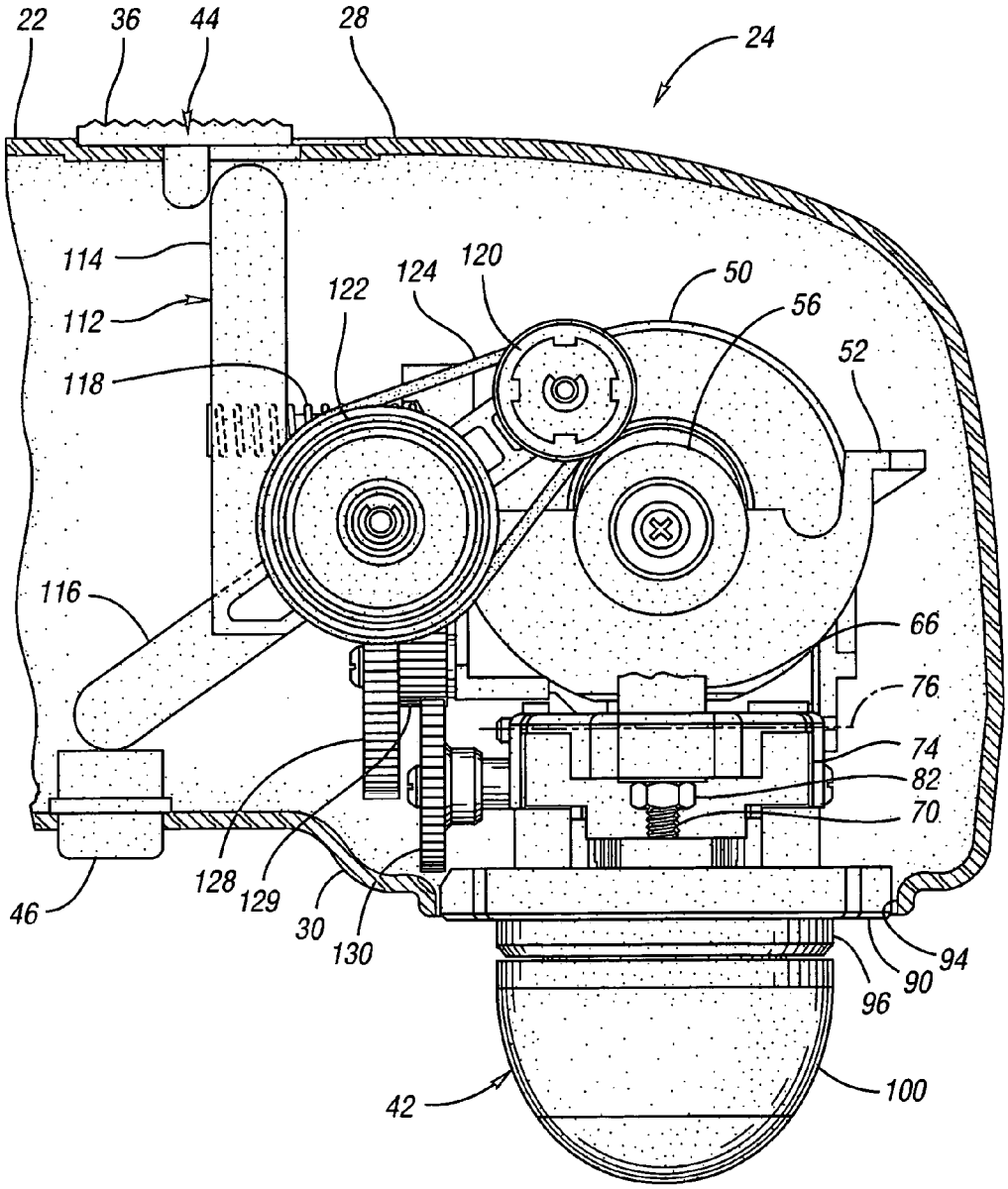
FIG. 7 is a side, cross-sectional view of the massage head portion of the percussive body massager taken along line 7—7 of FIG. 5.

Referring now to the exploded view of FIGS. 4*a* and 4*b* and the cross-section view of FIG. 5 (taken along line 5—5 of FIG. 3), massager 20 is provided with an electric motor 50 which is disposed within the massage head portion 24 of top housing part 28. Massager 20 is generally symmetrical about a central plane which is perpendicular to the motor axis. Motor 50 is partially surrounded and preferably suspended above a massage surface, by a motor support unit 52 affixed within massage head portion 24. An output shaft 54 is rotatably driven by motor 50 and protrudes from motor 50 on either side thereof. A crank arm 56 is affixed to each end of the output shaft 54 adjacent the motor 50, so that the crank arms 56 rotate along with the output shaft 54. A first end 58 of a vertical connecting rod 60 is affixed eccentrically to the outside of each crank arm 56, preferably with a rotary bearing 62 (best shown in FIG. 4) in between crank arm 56 and connecting rod 60.

In operation, the rotation of output shaft 54 by motor 50 causes each connecting rod 60 to reciprocate axially. More specifically, on one side of motor 50 the connecting rod 60 is attached to the crank arm 56 in a first offset location, such as above a longitudinal axis 64 of output shaft 54, depicted as the left connecting rod 60 in FIG. 5. On the other side of motor 50, the connecting rod 60 is attached to the crank arm 56 at a second offset location. The second offset location is preferably 180° from the first offset location, such as below longitudinal axis 64 of output shaft 54 as depicted as the right connecting rod 60 in FIG. 5. Therefore, as output shaft 54 rotates, connecting rods 60 are moved up arid down asynchronously due to their reciprocal eccentric attachment locations.

Still referring to FIGS. 4*a*, 4*b* and 5, elastomeric studs 66, preferably formed from a resilient material such as rubber, each have first and second threaded rods 68, 70 extending from each axial end thereof. The first threaded rods 68 are affixed or fastened to second end 72 of each connecting rod 60. The second threaded rods 70 are connected to an elongated rocker arm 74, which is attached to motor support unit 52 at a central pivot axis 76. More specifically, rocker arm 74 includes transversely spaced apart end portions 78 having apertures 80 aligned and sized to receive the second threaded rods 70 of the elastomeric stud 66. Further, a fastener such a s a threaded nut 82 is mounted to the second threaded rods 70, thus securing the connection between the elastomeric stud 66 and end portion 78 of rocker arm 74. Elastomeric studs 66, and corresponding connecting rods 60, are fixed to either end of rocker arm 74 in this manner, such that rocker arm 74 is moved about the central pivot axis 76 upon the rotation of output shaft 54.

Each connecting rod 60 has a separate attachment to rocker arm 74 adjacent a massage node 42. Each connecting rod 60 operates substantially independently to drive the associated node 42 which causes the movement of rocker arm 74 about central pivot axis 76. Therefore, this design minimizes the bending load on the rocker arm 74 enabling the rocker arm 74 to be thinner and lower in height. The present invention contemplates that the rocker arm 74 may be any percussion arm that imparts a percussive massage effect upon the massage nodes 42. Although a rocker arm is illustrated, the percussion arm may, for example, be a slidable member reciprocating upon a linear path and imparting a percussive massage effect upon the massage nodes 42. However, a rocker arm is preferred for imparting a percussive massage effect through a plurality of massage nodes 42.

The rocker arm 74 includes a channel 84, as best illustrated in FIG. 4, sized to receive a pair of slideblocks 86. Extending from each slideblock 86 is a threaded rod 88 for mounting the massage nodes 42. A rocker cap 90 is fastened atop the rocker arm 74 and has slots 92 through which the threaded rods 88 protrude for affixing the massage nodes 42. The rocker cap 90 is sized to fit within an aperture 94 in the bottom part 30 of the massage head portion 24. The rocker cap 90 provides minimal and adequate clearance with the aperture 94 such that the only accessible moving elements of the massager 20 are the massage nodes 42 and the rocker cap 90.

The massage nodes 42 are preferably hemispherically shaped and extend at least partially outside of the housing 22 in order to provide the massage surface. It is understood, of course, that more than two massage nodes 42 may be included in the massage surface and that massage nodes 42 can have any shape suitable to impart the desired massage effect. It is also contemplated that not all massage nodes 42 within the massage surface are movable with respect to the housing 22. The invention further contemplates that a massage surface may also be created by at least one massage node 42 fixed with respect to the housing and at least one massage node 42 movable with respect to the housing 22 for imparting the percussive massage effect.

Each massage node 42 includes a mounting plate 96, an internal frame 98, and an exterior surface member 100. The mounting plates 96 are threadably fastened to the threaded rods 88 and cover and protect the slots 92 formed within the rocker cap 90. The mounting plates 96 transfer the load experienced by the massage nodes 42 due to the percussive massage effect, to the rocker cap 90 and consequently to the rocker arm 74. This load transfer protects the slideblocks 86 from experiencing the percussive loads. The internal frame 98 is fastened to the mounting plate 96. The exterior surface members 100 are removably fastened to an external thread about the internal frames 98. Exterior surface members 100 of massage nodes 42 comprise a resilient, preferably rubber material. Preferably, alternate sets (not shown) of external surface members 100 are provided for attachment to massager 20 of the present invention. The sets of external surface members 100 would be of different densities or durometers to provide the options of soft, medium, or hard massage application. To change to a different set, a user can simply unscrew the exterior surface members 100 by hand from the internal frame 98 and replace with the desired set.

It is well known in the art, that heat may be provided to the massage nodes 42, by resistors or necessary heating elements (not shown) housed therein. As illustrated, a conductor 102 protrudes from a top portion of each internal frame 98 such that it contacts a conductor (not shown) formed within each exterior surface member 100, thus improving the heat transfer through the massage node 52 to the user.

The slideblocks 86 are slidably mounted upon a guide shaft 104 for movement along a linear path within the channel 84 of the rocker arm 74. The positioning of the slideblocks 86 determines the positioning and variable spacing of the massage nodes 42. The slots 92 within the rocker cap 90 allow the threaded rod 88, interconnecting the massage nodes 42 and the slideblock 86, to slide toward and away from a central region 106 of the massage head portion 24. Although the invention illustrates and describes the slideblocks 86 as being positioning members for the massage nodes 42, the invention contemplates any mechanism known in the art for providing variable spacing of the massage nodes 42, such as a pivotal lever movable along an arcuate path, and thus only a portion of the positioning member may be driven towards and away from the central region 106.

Figure 10:
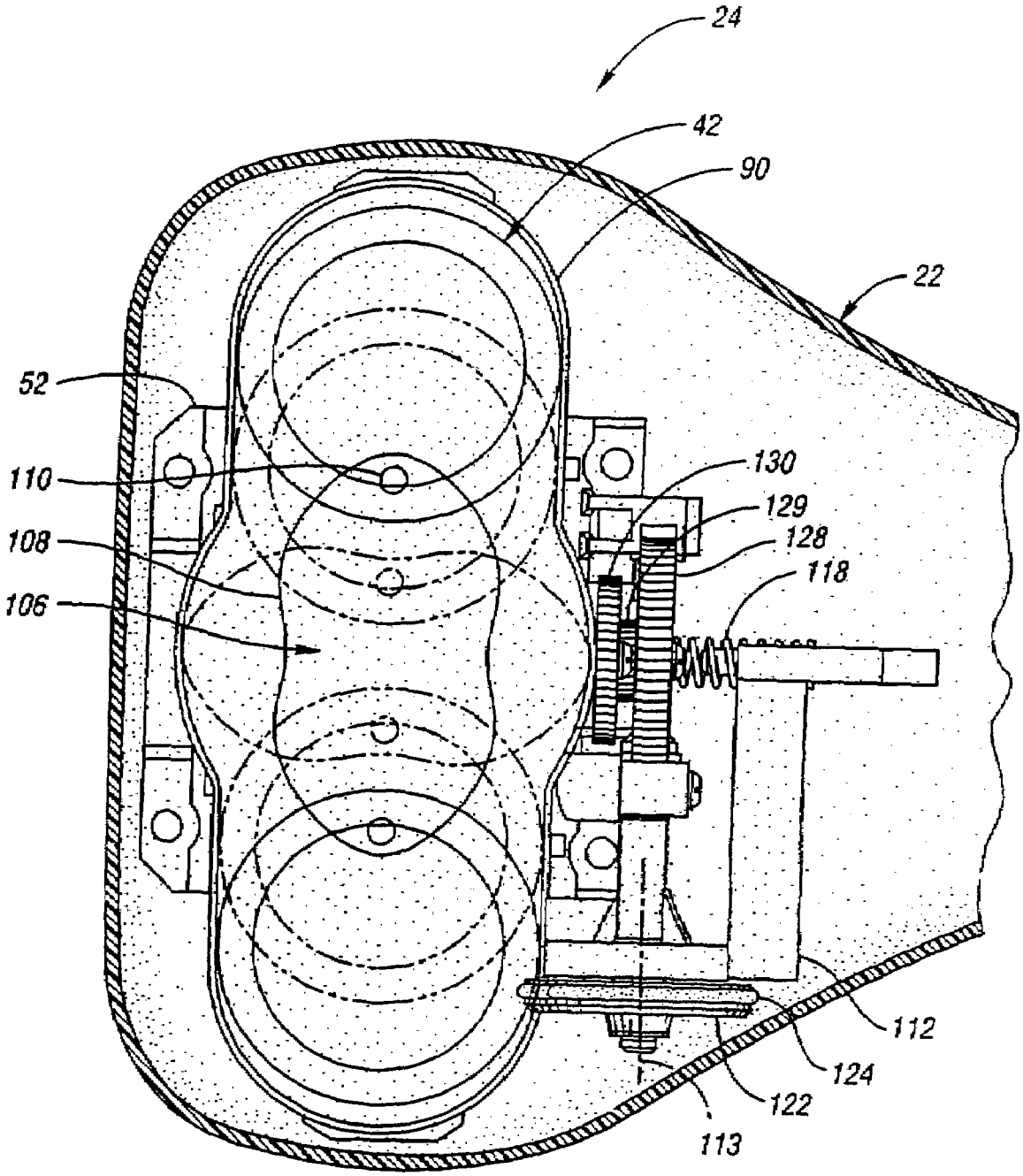
FIG. 10 is a bottom, partial section view of the massage head portion illustrating variable spacing of massage nodes.

The position and spacing of the slideblocks 86 is determined by a cam 108 engaged with the slideblocks 86. The cam is rotationally mounted atop the rocker arm 74 and has a peripheral groove formed within and engaged with a pair of pegs 110, each extending from one of the slideblocks 86. The cam 108 is symmetrical in shape such that the pair of slideblocks 86 each reciprocate in a manner such that the slideblocks 86 are in phase with each other. Therefore, as the cam is rotatably driven with respect to the rocker arm 74, the slideblocks 86 synchronously reciprocate along the linear path provided by the guide shaft 104 toward and away from the central region 106 of the massage head portion 24. This feature is best illustrated in FIGS. 5 and 10. The cam 108, represented in solid, drives the massage nodes 42 away from the central region 106 of the massage head portion 24. As the cam 108 rotates ninety degrees, illustrated in phantom, the nodes 42, also illustrated in phantom, travel toward the central region 106. As the cam continues to rotate, the massage nodes are progressively driven towards and away from the central region 106 such that they reciprocate with respect to the rocker arm 74.

The present invention prefers a cam 108 for imparting a reciprocal motion upon a pair of positioning members as illustrated by the slideblocks 86. However, any rotary mechanism may be provided within the invention for imparting a reciprocating motion upon at least two positioning members. For example, the rotary mechanism may be a linkage assembly for imparting reciprocal motion upon a pair of positioning members. Further, the rotary member may be a wobble drive having a wobble plate rotationally mounted to an axis canted with respect to the rotational axis wherefore engaged ends of the wobble drive impart reciprocal motion to a pair of positioning members. The invention contemplates that the rotary mechanism may also be a lead screw having a pair of oppositely threaded regions. A pair of positioning members would each be threadably engaged with one of the pair of oppositely threaded regions. A drawback to this concept is that the rotation of the rotary mechanism requires a reverse rotation in order to progressively change the direction of motion of the slide blocks. Therefore, a cam or any similar rotary member that imparts a reciprocating motion is preferred.

The cam 108 is rotationally driven by an ancillary transmission within the housing 22 of the percussive massager 20. Rather than adding a second motor to the percussive massager 20, which would greatly increase the cost and the weight of the massager, an ancillary transmission provides a reduced rotation from the motor 50 that drives the percussive massage effect of the massager 20. The ancillary transmission has an output connected to or engaged with the cam 108 and an input operably coupled with the motor output shaft 54 for imparting the reduced rotation from the motor output shaft 54 to the cam 108 and translating the reciprocating motion of the slideblocks 86.

Referring now to FIGS. 6–9, the ancillary transmission is discussed in further detail. The ancillary transmission includes an actuation member 112 pivotally connected to the motor support unit 52 about a pivotal actuation axis 113. The actuation member 112 is pivotal such that it may be actuated for operably engaging the ancillary transmission input with the motor output shaft 54.

The actuation member 112 includes top and bottom operating levers 114, 116, each extending toward the respective housing top 28 and housing bottom 30. The top operating lever 114 cooperates with the variable spacing switch 36 for actuating the actuation member 112. The bottom operating lever 116 cooperates with the variable spacing button 46 for actuating the actuation member 112 also. The actuation member 112 is biased by a spring 118 disposed between the top operating lever 114 of the actuation member 112 and the motor support unit 52 for disengaging the ancillary transmission input from the motor output shaft 54. A user-applied force applied to the variable spacing button 46 compresses the spring 118 for engagement of the ancillary transmission. When the user-applied force is removed, the compression spring 118 disengages the ancillary transmission. When the variable spacing switch 36 is indexed to the first position 40, the acuation member 112 compresses the spring 118 continuously for continuous engagement of the ancillary transmission. The ancillary transmission does not become disengaged, and the spring 118 does not extend until the user returns the variable spacing switch 36 to the second position 44.

Figure 8:
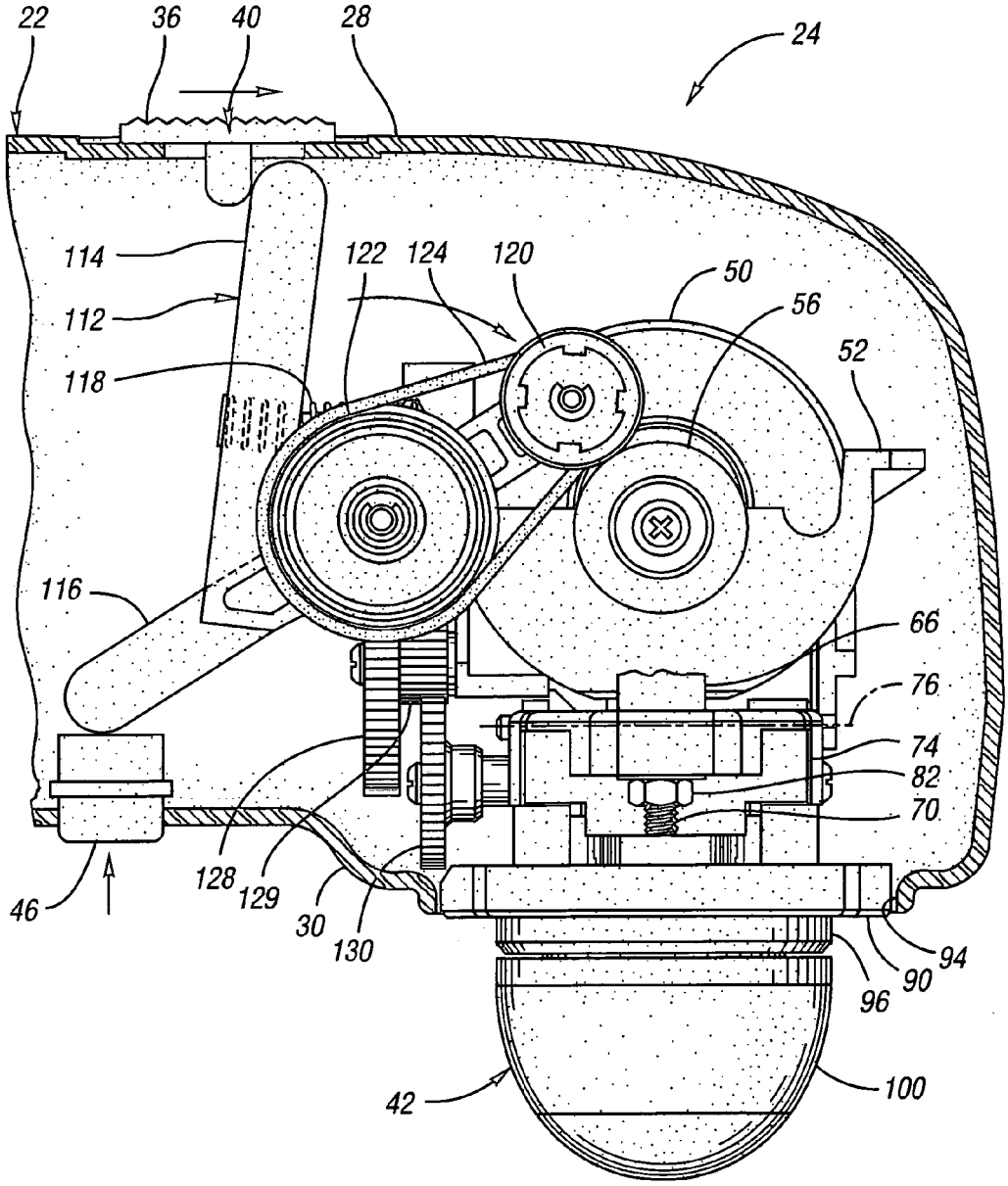
FIG. 8 is a side, cross-sectional view of the massage head portion of the percussive body massager similar to FIG. 7, illustrating engagement of an ancillary transmission.

The actuation member 112 extends from the central region 106 of the massage head portion 24 proximate one of the ends of the motor 50. The ancillary transmission input is defined as a roller 120 rotationally mounted to the actuation member 112 at a spaced apart location from the actuation axis 113. As illustrated in FIG. 8, when the actuation member 112 is actuated to the engaged position of the ancillary transmission, the roller 120 rotationally engages the crank arm 56 on one side of the motor 50 such that the crank arm 56 imparts a corresponding rotational motion to the roller 120, driving the roller and consequently driving the ancillary transmission.

A reduction wheel 122 is rotationally mounted to the actuation member 112 coaxial with the pivotal actuation axis 113. The reduction wheel 122 is driven for reduced rotation by a belt 124 interconnecting the reduction wheel 122 and roller 120. The reduction wheel 122 is rotationally connected to a worm drive 126 coaxial with the pivotal actuation axis 113. The ancillary transmission further includes a worm gear 128 mounted to the motor support unit 52 for rotation with respect to the motor support unit 52. The worm gear 128 is engaged and driven by the rotation of the worm drive 126 for transmitting an even further reduced rotation within the ancillary transmission.

Figure 9:
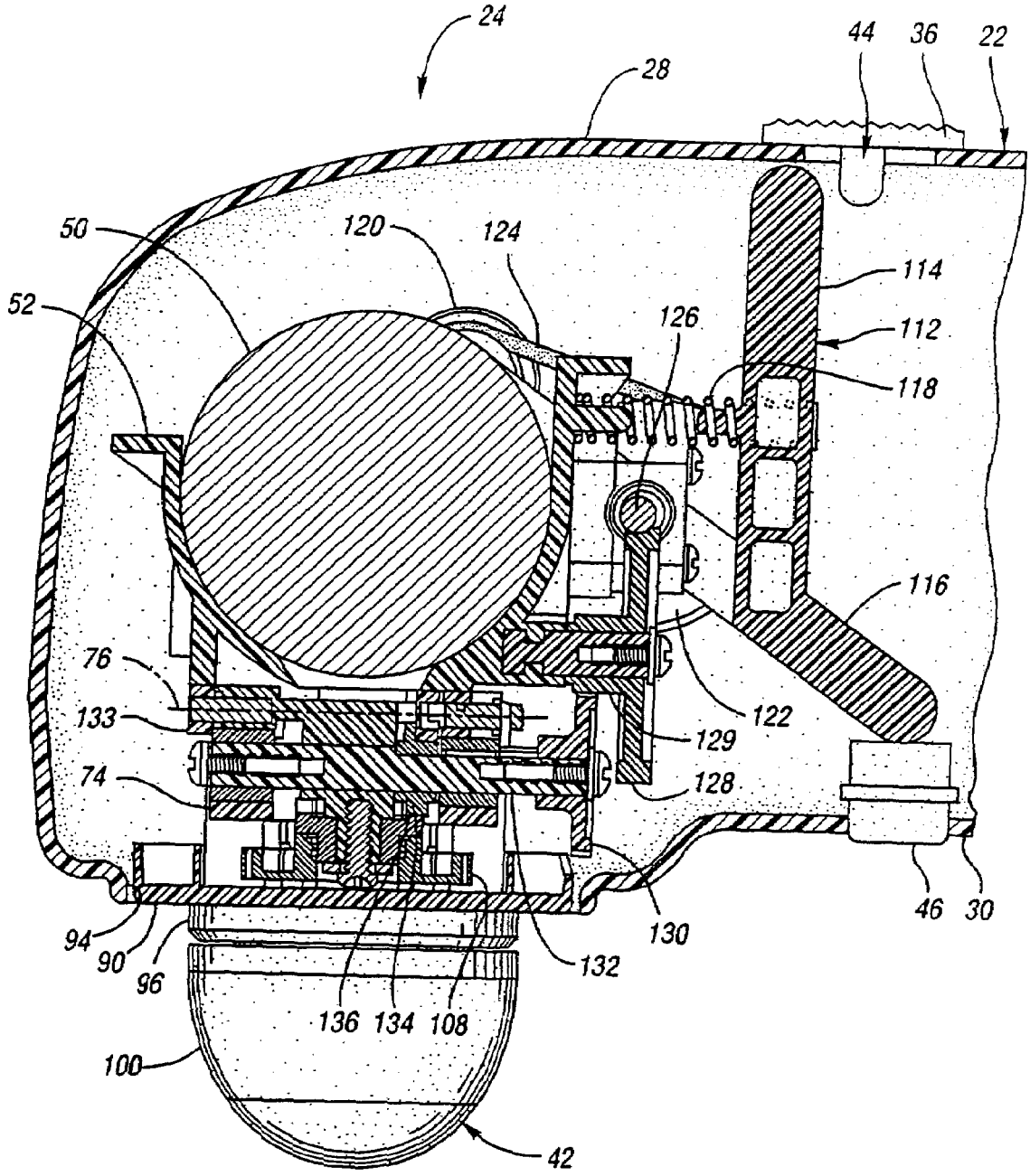
FIG. 9 is a side, cross-sectional view of the massage head portion of the percussive body massager taken along line 9—9 of FIG. 6.

The ancillary transmission is ever further reduced by the worm gear 128 having a smaller diameter external gear portion 129 engaged with a reduction gear 130 mounted to a gear shaft 132 as best illustrated in FIG. 9. The gear shaft 132 is rotationally mounted to the rocker arm 74 parallel to the central pivot axis 76 by a pair of rotary bearings 133 mounted within the rocker arm 74.

An external gear 134 is mounted upon and driven by the gear shaft 132. The external gear 134 is disposed within the rocker arm 74 proximate to the cam 108. A face gear 136 is mounted to the cam 108 for rotation therewith. The face gear 136 is engaged with, and driven by the external gear 134, thus defining the output of the ancillary transmission.

The invention contemplates any ancillary transmission for imparting rotation from the motor 50 to the rotary member. Preferably the ancillary transmission reduces the rotation of the cam with respect to the motor 50 and comprises any combination of gears, belts, pulleys or the like for achieving this result. For example, the reduction gear 130, gear shaft 132, external gear 134 and face gear 136 could be replaced by a belt driven by a pulley connected to the worm gear 128 and rotationally connected to a pulley mounted to the cam 108.

The ancillary transmission allows a user to couple a reduced rotation from the motor 50 to the cam 108. This reduction has an approximate ratio of 100 to 1, therefore the variable spacing of the nodes 42 is gradual with respect to the oscillating rocker arm 74 and percussive massage effect. Of course, the speed of the increasing and decreasing nodes is derived from the speed of the percussive massage effect as controlled by the variable speed lever 34.

In summary, the exemplary percussive body massager 20 illustrated in FIGS. 1–10 of the present invention operates as follows. Motor 50 rotatably drives output shaft 54, which in turn rotates affixed crank arms 56 to cause an asynchronous, axial movement of eccentrically attached connecting rods 60. Elastomer studs 66 affixed to connecting rods 60 interface with rocker arm 74 to cause it to move back and forth about its central pivot axis 76 with respect to motor support unit 52. Slideblocks 86, mounted within rocker arm 74, have threaded rods 88 extending through rocker cap 90 through aperture 94 formed in massage head portion 24 of bottom housing part 30. Massage nodes 42, which form the massage surface, are fastened to these threaded rods 88, such that the massage nodes 42 are moved asynchronously and independently by connecting rods 60 toward and away from massage head 24 to provide a percussive massage effect. Advantageously, the design of massager 20 assures that massage nodes 42 will continue to function properly even if one connecting rod 60 becomes inoperative.

The variable spacing of the massage nodes 42 is summarized as follows. Actuation member 112 may be actuated by either variable spacing lever 36 or variable spacing button 46 for respective continuous or intermittent engagement of the ancillary transmission to the motor output shaft 54. The roller 120 engages and is driven by one of the crank arms 56 and imparts a reduced rotation to the reduction wheel 122 through the belt 124. The reduction wheel 122 rotates the worm drive. 126 which consequently imparts reduced rotation to the worm gear 128. Further reduction is created through engagement of the worm gear 128 and reduction gear 130. The reduction gear 130 drives the gear shaft 132 upon which external gear 134 is disposed for driving the face gear 136 of the cam 108. This rotation of the cam 108 imparts a reciprocating motion upon the slideblocks 86 such that the slideblocks 86 synchronously reciprocate toward and away from the central region 106 of the massage head portion 24. The reciprocal motion of the slideblocks 86 imparts a progressive increasing and decreasing of the spacing of the massage nodes 42.

The massage nodes 42 may be heated by conduction of electricity through resistors located within the massage nodes 42. Percussive massager 20 of the present invention provides a user with a percussive massaging effect having the options of variable speed of the percussive massage effect, temporary or continuous adjustment of the spacing of the massage nodes 42, and heat transferred through the massage nodes 42. These options in part or in combination provide a relaxing massaging effect to the user in a low-weight, low-cost percussive massager 20.

Figure 11:
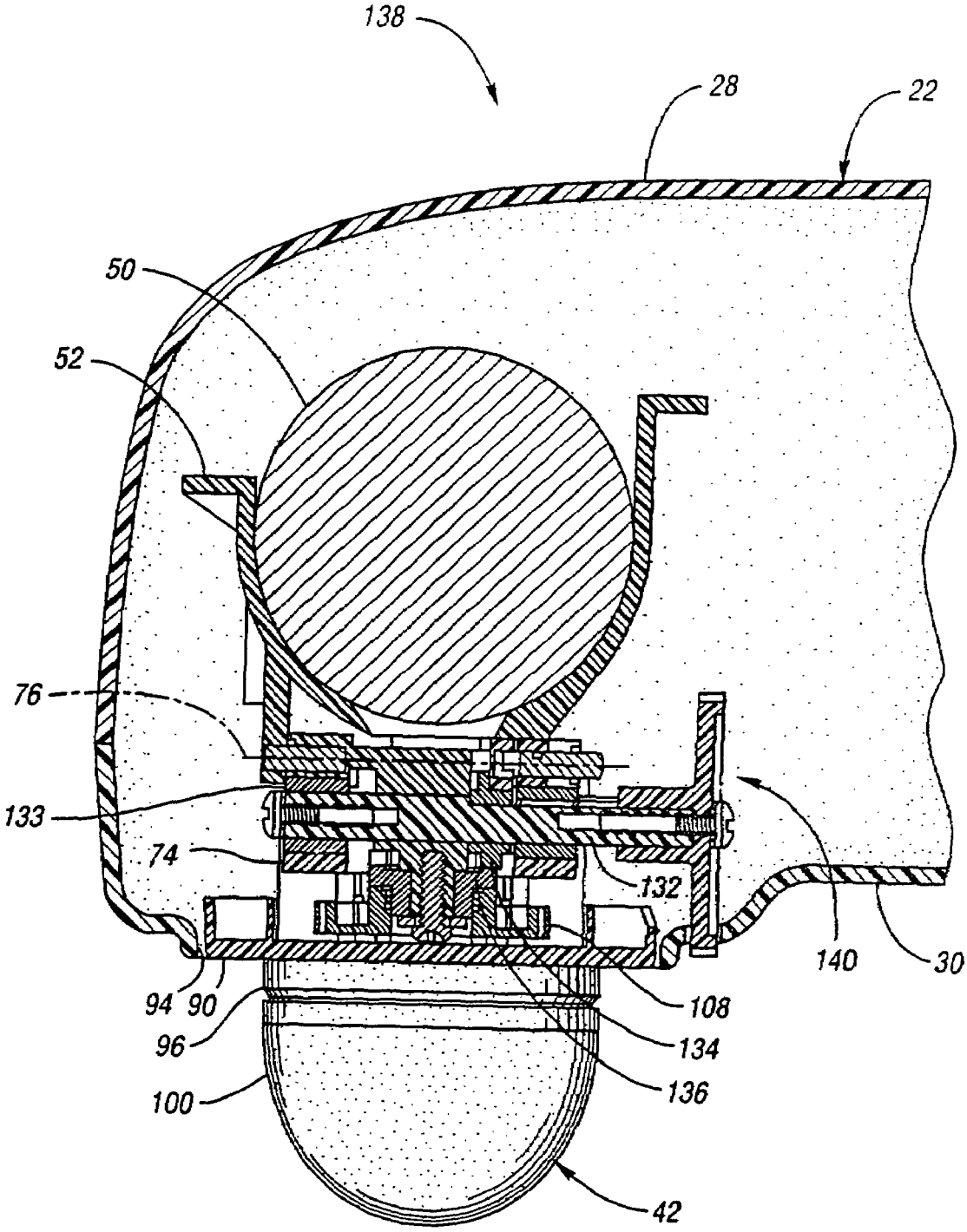
FIG. 11 is a side, cross-sectional view of a massage head portion of an alternative embodiment percussive body massager.

Referring now to FIG. 11, a cross-section of a second alternative embodiment percussive massager is illustrated for detailed disclosure herein. Similar elements to those incorporated in the preferred embodiment retain like reference numerals, wherein new or undisclosed elements are referenced by new reference numerals. The percussive massager of FIG. 11 is similar to the preferred embodiment percussive massager, however the ancillary transmission is simplified. The ancillary transmission connects the rotary mechanism or cam 108 to an adjustment mechanism 140 extending out of the housing 30 for manual adjustment thereof.

Similar to the preferred embodiment, the percussive massager 138 includes a pair of slide blocks 86 synchronously reciprocated by a cam 108 having a face gear 136 driven by an external gear 134 rotationally driven about gear shaft 132. The gear shaft 132 is manually driven by the adjustment mechanism 140. The adjustment mechanism 140 is illustrated in FIG. 11 as an external face gear having a large diameter extending out of the housing, such that a user may manually impart a rotation thereupon for consequently varying the spacing of the massage nodes 42. The prior art teaches a similar method for manually varying the spacing of the massage nodes, however the rotary mechanism of the prior art is a lead screw having a pair of oppositely threaded regions wherein each slide block is threadably engaged to one of the oppositely threaded regions. Thus, the prior art requires a user to manually drive the rotary mechanism in one direction to increase the spacing between the massage nodes and also drive the rotary mechanism in another direction to decrease the spacing of the massage nodes. The advantage provided by the cam 108 is that the spacing of the massage nodes 42 may be progressively increased and decreased by rotating the adjustment mechanism in a single rotational direction without having to reverse directions as the spacing of the massage nodes 42 reaches a minimum or maximum limit.

The invention contemplates that the adjustment mechanism can be embodied by any rotary mechanism for imparting rotation to the gear shaft 132. These rotary mechanisms may include but are not limited to gears, knobs, handles, wheels, or the like.

Figure 12:
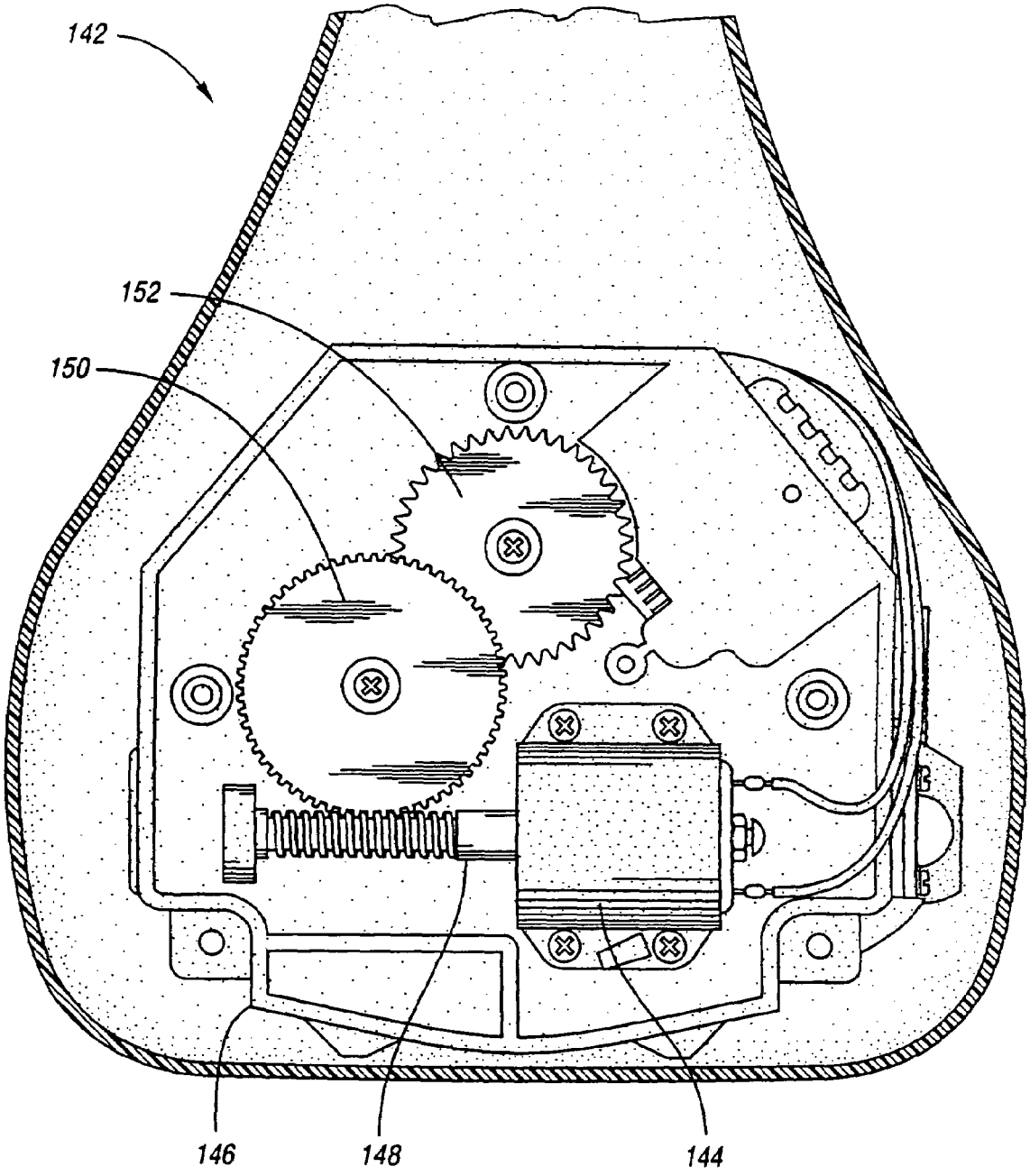
FIG. 12 is a top plan view of an ancillary transmission of another alternative embodiment percussive body massager.
Figure 13:
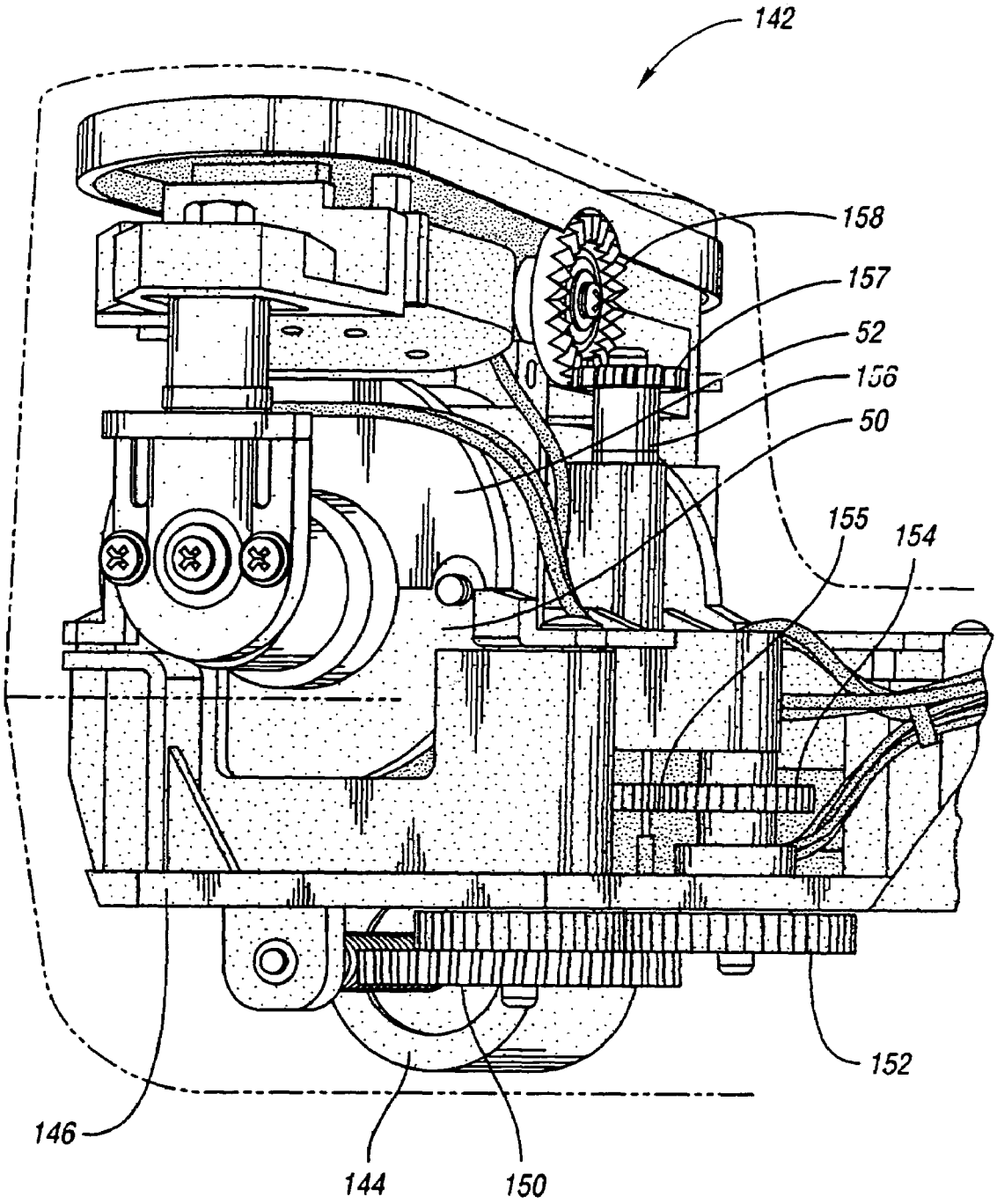
FIG. 13 is a side perspective view of the percussive body massager of FIG. 12.

Referring now to FIGS. 12 and 13 a third alternative embodiment percussive massager 142 is illustrated. Similar elements retain similar reference numerals wherein new elements retain new reference numerals. The percussive massager 142 is similar to the aforementioned embodiments, however the ancillary transmission is selectively driven by a second motor 144 supported within the housing.

In FIG. 12, the second motor 144 is shown secured to a secondary motor support unit 146. The secondary motor support unit 146 is securable within the housing top 28 and the motor support unit 52 is affixable thereto for securing the first motor 50 (as illustrated in FIG. 13).

Referring now to FIG. 12, the ancillary transmission includes a worm drive 148 rotationally driven by the second motor 144. The ancillary transmission further includes a worm gear 150 driven by the worm drive 148 and imparting a reduced rotation to a reduction gear 152. The second motor 144 and ancillary transmission including the worm drive 148, the worm gear 150, and the reduction gear 152 are supported for rotation by the secondary motor support unit 146. Of course, the invention contemplates that the second motor 144 and the ancillary transmission may be secured by other means within the housing 22.

Referring now to FIG. 13, the reduction gear 152 is rotationally connected with a pinion gear 154 for driving an external gear 155 mounted to a second gear shaft 156. The second gear shaft 156 has a pinion gear end 157 proximate to the rocker arm 74 engaged with a crown gear 158 for driving the gear shaft 132. As illustrated in the preferred embodiment in FIG. 9, the gear shaft 132 drives external gear 134 for imparting rotation to the rotary member or cam 108.

Although this third embodiment is more expensive than the aforementioned first and second embodiments due to the second motor 144, the secondary motor support unit 146 and the multiple gears required in the ancillary transmission, the second motor 144 provides more flexibility in the controls of the variable node spacing. As discussed previously, the cam 108 is the preferred rotary member because continuous rotation thereof imparts repetitive reciprocating motion to the positioning members. The two motor embodiment is operational with a rotary mechanism that imparts continuous reciprocating motion to the positioning members or to a rotary member that imparts longitudinal movement to the positioning member in one rotational direction thereof and in the opposite direction in the reverse rotation thereof. For example, the two motor embodiment may be used in conjunction with a rotary member having a pair of oppositely threaded regions for driving positioning members threadably engaged thereto. This rotary mechanism and positioning member combination may be preferred over the cam 108 because it may be more susceptible to the loads experienced by the slide blocks during the combined variable spacing of the massage nodes and percussive massage effect.

One of the advantages of the two motor embodiment is that the speed of the variable node spacing is independent of the speed of the percussive massage effect. This feature provides the user with the benefit of selecting a preferred speed for the percussive massage effect and an independent preferred speed of the variable node spacing. Independent speeds are not provided in the one motor design of the first embodiment, wherein the speed of the variable node spacing is a function of the speed of the first embodiment percussive massage effect.

Another advantage of the two motor embodiment is that the operation of the variable node spacing may be conducted independent of the operation of the percussive massage effect. This advantage allows a user to operate the variable node spacing temporarily, continuously, intermittently, or a function of a programmed spacing in combination with various percussive massage effect rhythms.

A two motor embodiment does not limit the rotary member to being a cam 108 or the like, as driven rotationally for imparting a reciprocating motion to the positioning members. The rotary member may be a lead screw having a pair of oppositely threaded regions for imparting linear movement to a pair of positioning members each threadably engaged to one of the threaded regions. The rotation of the second motor 144 may be operated in one direction for increasing the spacing of the massage nodes and operated in an opposite direction for decreasing the spacing of the massage nodes.

The controls of the second motor 144 may be further enhanced by including a torque sensor within the second motor 144 for signaling when the torque level peaks thereby exceeding normal torque levels. This peak in the torque level corresponds to a limit in the movement of the positioning members, such that when the spacing of the nodes reaches a minimum or maximum and the range of travel of the positioning members reaches a limit, the torque experienced by the second motor 144 increases and is signaled by the torque sensor thereby discontinuing the rotation of the second motor in that direction. However, in a continuous mode the signal reverses the rotation of the second motor 144 until the positioning member reaches a limit in its travel. The operation continues in cycle reversing the second motor 144 for continuous variable node spacing.

The benefits and advantages provided by incorporating a torque sensor within the second motor 144 may be provided by alternatively including a current sensor in series with the second motor 144. Accordingly, the current sensor would measure a peak in the current caused by a limit in the travel of the positioning members.

Figure 14:
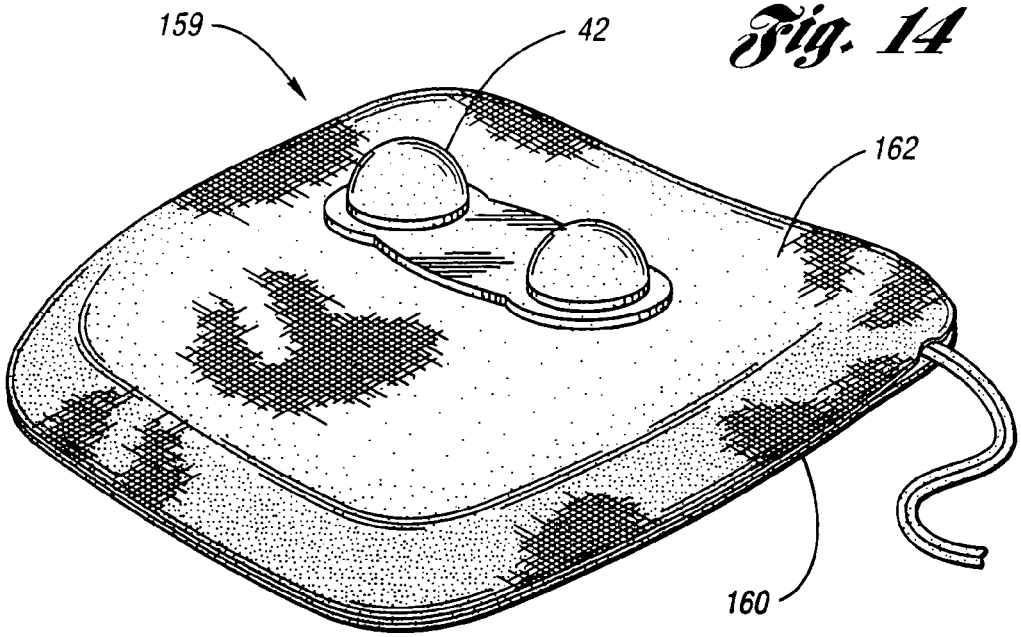
FIG. 14 is a side perspective view of an alternative embodiment cushion percussive body massager.

Referring now to FIG. 14, a fourth alternative embodiment cushion percussive body massager 159 is illustrated. The cushion percussive body massager 159 is similar to the above-described embodiments, however the housing is attached to or integral with a back plate 160 sized to be affixable to a chair or the like. This embodiment further includes cushioning material 162 covering the back plate 160 and providing a cushioned support to a user from a majority of the contact surface of the back plate 160. The spaced apart massage nodes 42 protrude therefrom at a location optimized for providing the percussive massage effect to a portion of the back of a user when sitting in the chair. The cushion massager 159 includes a cover (not shown) having a strap or plurality of straps for mounting the cushion massager 159 to an upright back support of the chair. The switches, buttons or adjustment mechanisms for operating the functions of the percussive massage effect and variable node spacing are mounted to one of the sides of the back plate 160, or are mounted on a hand-held remote electronically wired to the cushion massager 159 for ease in operation while sitting in the chair.

Figure 15:
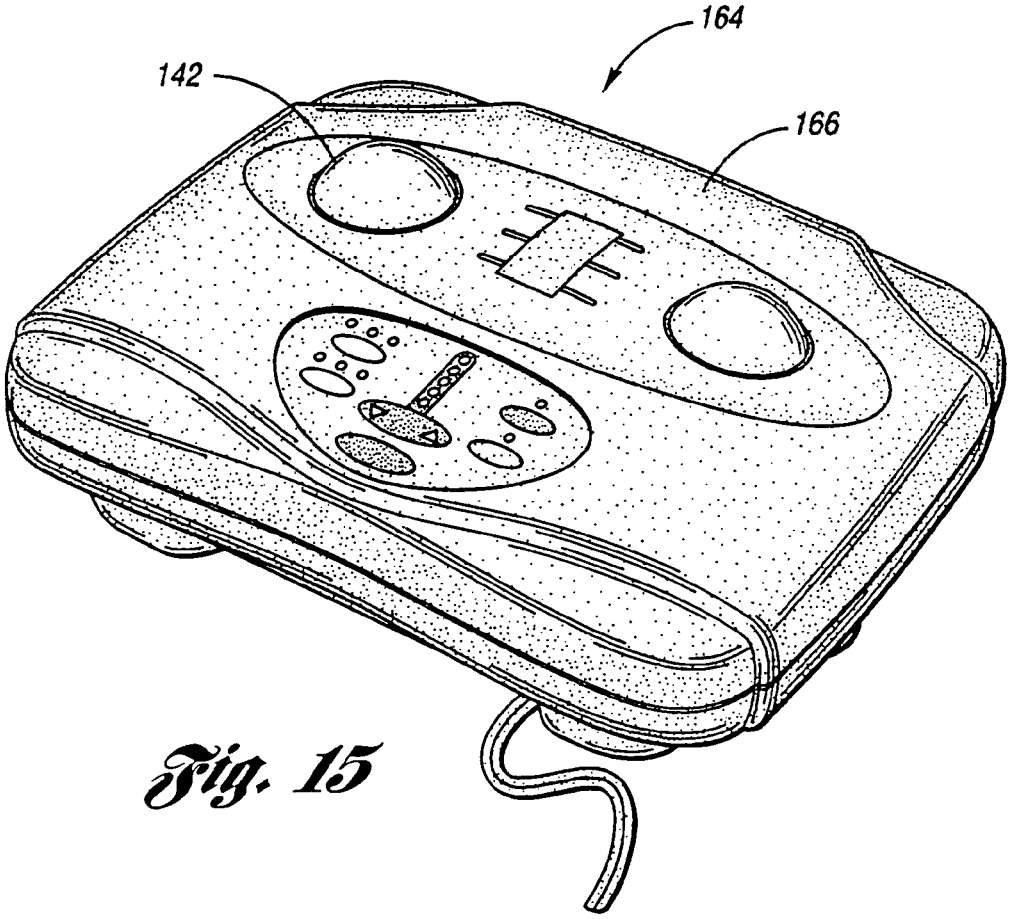
FIG. 15 is a top perspective view of an alternative embodiment percussive foot massager.

A fifth alternative embodiment percussive foot massager 164 is illustrated in FIG. 15. The foot massager 164 contrasts with the above-disclosed embodiments wherein a housing 166 is sized to be placed on a planar surface such as a floor or the like. Further, the housing 166 is sized to receive a pair of feet for supporting the feet while providing the percussive massage effect thereto. The pair of spaced apart massage nodes 42 extend from a top surface of the housing 166 at a location ideal from massaging the feet wherein the massage nodes 42 are sufficiently spaced apart such that each massage node imparts the percussive massage effect to each foot. The switches, buttons or adjustment mechanisms for controlling the operation of the foot massager 164 are located in a central region atop the massager housing 164, accessible to the user and avoiding the placement of the feet.

Figure 16:
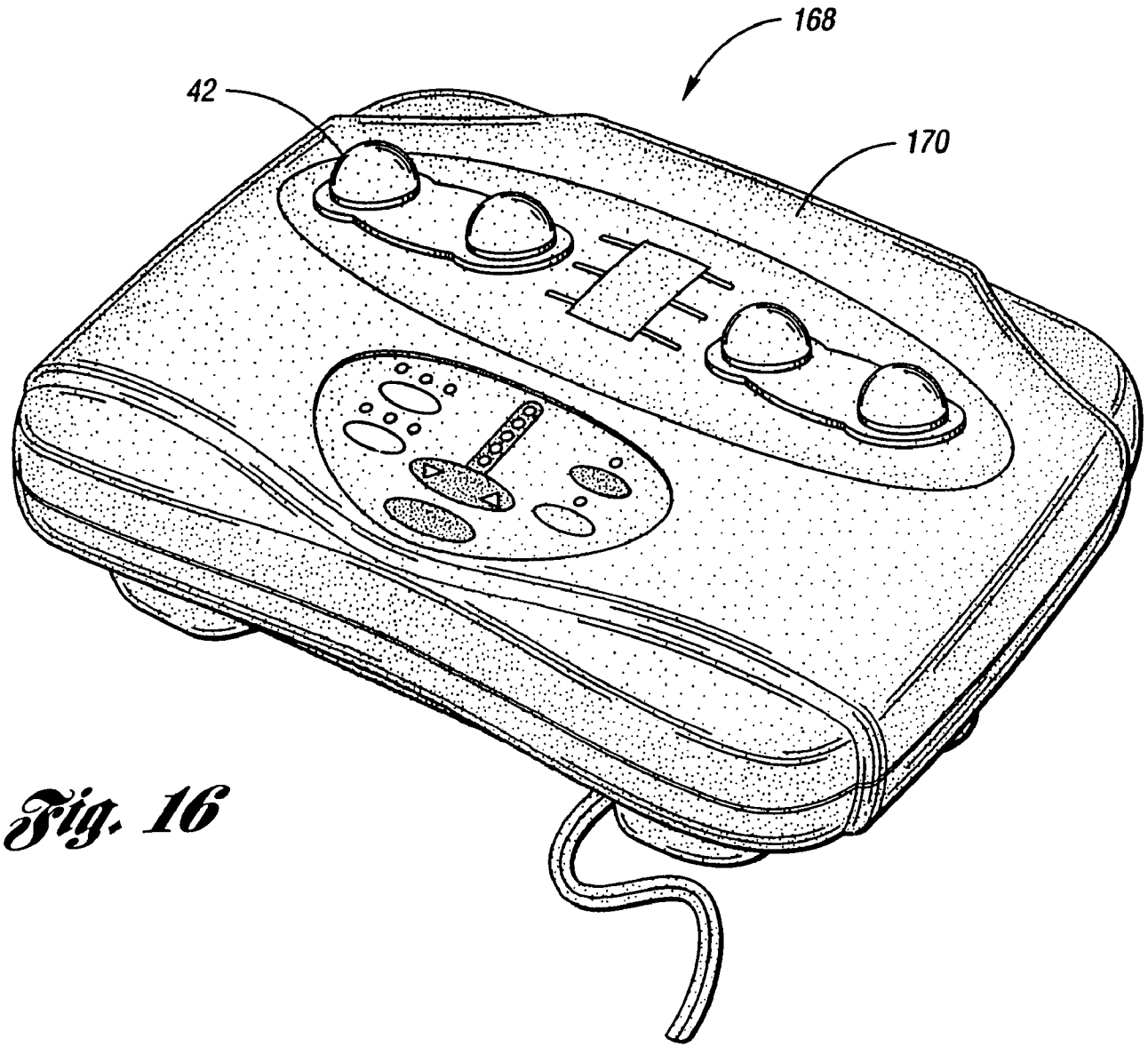
FIG. 16 is yet another alternative embodiment of a percussive foot massager.

A sixth percussive foot massager 168 embodiment is illustrated in FIG. 16. The percussive foot massager 168 is similar to the prior foot massager 164, however this embodiment incorporates a pair of percussive massagers each including a pair of spaced apart massage nodes 42. Each pair of massage nodes 42 are located protruding from a housing 170 such that a user can place one foot on each pair of massage nodes 42. The percussive foot massager 168 allows a user to control a combination of a percussive massage effect and variable node spacing to each foot independently.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A percussive massager comprising:

a housing;

a motor supported by the housing, having a rotatably driven output shaft;

a percussion arm movably connected to the housing and operably driven by the motor output shaft;

at least one positioning member;

at least two spaced apart massage nodes operably connected to the percussion arm, at least one of the at least two massage nodes being attached to the at least one positioning member, the at least two massage nodes forming a massage surface, wherein at least one of the at least two massage nodes is moved toward and away from the housing by operable connection to the motor output shaft to provide a percussive massage effect;

a rotary mechanism rotatable with respect to the percussion arm and engaged with the at least one positioning member such that rotation of the rotary mechanism drives a portion of the at least one positioning member toward and away from a central region of the housing; and an ancillary transmission having an output and an input, the transmission output being connected to the rotary mechanism, and the transmission input being operably engaged with the motor output shaft;

wherein the ancillary transmission couples the motor output shaft to the rotary mechanism such that the rotary mechanism drives the portion of the at least one positioning member to progressively increase and decrease the spacing between the at least two massage nodes.

2. The percussive massager of claim 1, wherein the motor output shaft protrudes from the motor on either side thereof; and further comprising:

a pair of connecting rods each having a first end and a second end, wherein the first ends are operably connected to the motor output shaft such that rotation of the motor output shaft causes the connecting rods to reciprocate axially in an asynchronous manner;

wherein the percussion arm is further defined as a rocker arm attached to the housing at a pivot axis thereof, wherein the rocker arm is operably connected to the second ends of the connecting rods and is moved about the pivot axis by rotation of the motor output shaft such that the at least two massage nodes are moved asynchronously toward and away from the housing by each of the connecting rods to provide the percussive massage effect.

3. The percussive massager of claim 1, wherein the transmission output is further defined as an external gear engaged with a face gear rotationally connected with the rotary mechanism.

4. The percussive massager of claim 1, wherein the at least two massage nodes include resistors wired for conducting heat therethrough.

5. The percussive massager of claim 1, further defined as a hand-held massager.

6. The percussive massager of claim 1, further defined as a non hand-held massager.

7. The percussive massager of claim 1, further defined as a cushion massager.

8. The percussive massager of claim 1, further defined as a foot massager.

9. A foot massager comprising at least two spaced apart percussive massagers, each as specified in claim 1.

10. The percussive massager of claim 1, further comprising an actuation member cooperable with the transmission input for selectively engaging and disengaging the transmission input with the motor output shaft.

11. The percussive massager of claim 10, wherein a spring cooperates with the actuation member and the housing for disengaging the transmission input from the motor output shaft allowing a user-applied force applied to the actuation member, to bias the spring such that the transmission input engages with the motor output shaft.

12. The percussive massager of claim 10, wherein the actuation member is actuated by a user to a first position wherein the transmission input is continuously engaged with the motor output shaft and the actuation member is actuated by the user to a second position wherein the transmission input is continuously disengaged with the motor output shaft.

13. The percussive massager of claim 1, wherein the transmission input is further defined as a roller for rolling engagement with a crank arm rotationally driven by the motor output shaft.

14. The percussive massager of claim 13, wherein the ancillary transmission includes a reduction wheel rotationally driven by a belt interconnecting the roller and reduction wheel.

15. The percussive massager of claim 14, wherein the ancillary transmission includes a worm drive rotationally driven by the reduction wheel for imparting a further reduced rotation to a worm gear within the ancillary transmission.

16. A percussive massager comprising:

a housing;

a motor supported by the housing, having a rotatably driven output shaft;

a percussion arm movably connected to the housing and operably driven by the motor output shaft;

at least two slideblocks connected to the percussion arm and movable along a linear path with respect to the percussion arm;

at least two spaced apart massage nodes, each being attached to one of the at least two slideblocks, the at least two massage nodes forming a massage surface, wherein the at least two massage nodes are moved toward and away from the housing by operable connection to the motor output shaft to provide a percussive massage effect;

a cam rotatable with respect to the percussion arm and engaged with the at least two slideblocks such that rotation of the cam drives each slideblock along the linear path toward and away from a central region of the housing; and an ancillary transmission having an output and an input, the transmission output being connected to the cam, and the transmission input being operably engaged with the motor output shaft;

wherein the ancillary transmission couples the motor output shaft to the cam such that the cam drives the at least two slideblocks to progressively increase and decrease the spacing between the at least two massage nodes.

17. The percussive massager of claim 16, wherein the motor output shaft protrudes from the motor on either side thereof; and further comprising:

a pair of connecting rods each having a first end and a second end, wherein the first ends are operably connected to the motor output shaft such that rotation of the motor output shaft causes the connecting rods to reciprocate axially in an asynchronous manner;

wherein the percussion arm is further defined as a rocker arm attached to the housing at a pivot axis thereof, wherein the rocker arm is operably connected to the second ends of the connecting rods and is moved about the pivot axis by rotation of the motor output shaft such that the at least two massage nodes are moved asynchronously toward and away from the housing by each of the connecting rods to provide the percussive massage effect.

18. The percussive massager of claim 16, wherein the transmission output is further defined as an external gear engaged with a face gear rotationally connected with the cam.

19. The percussive massager of claim 16, wherein the at least two massage nodes include resistors wired for conducting heat therethrough.

20. The percussive massager of claim 16, further defined as a hand-held massager.

21. The percussive massager of claim 16, further defined as a non hand-held massager.

22. The percussive massager of claim 16, further defined as a cushion massager.

23. The percussive massager of claim 16, further defined as a foot massager.

24. A foot massager comprising at least two spaced apart percussive massagers, each as specified in claim 16.

25. The percussive massager of claim 16, further comprising an actuation member cooperable with the transmission input for selectively engaging and disengaging the transmission input with the motor output shaft.

26. The percussive massager of claim 25, wherein a spring cooperates with the actuation member and the housing for disengaging the transmission input from the motor output shaft allowing a user-applied force applied to the actuation member, to bias the spring such that the transmission input engages with the motor output shaft.

27. The percussive massager of claim 25, wherein the actuation member is actuated by a user to a first position wherein the transmission input is continuously engaged with the motor output shaft and the actuation member is actuated by the user to a second position wherein the transmission input is continuously disengaged with the motor output shaft.

28. The percussive massager of claim 16, wherein the transmission input is further defined as a roller for rolling engagement with a crank arm rotationally driven by the motor output shaft.

29. The percussive massager of claim 28, wherein the ancillary transmission includes a reduction wheel rotationally driven by a belt interconnecting the roller and reduction wheel.

30. The percussive massager of claim 29, wherein the ancillary transmission includes a worm drive rotationally driven by the reduction wheel for imparting a further reduced rotation to a worm gear within the ancillary transmission.

31. A handheld percussive massager comprising:

a housing including a massage head portion and a handle portion;

a motor supported by the housing head portion;

a rotatably driven output shaft protruding from the motor on either side thereof;

a pair of connecting rods each having a first end and a second end, wherein the first ends are operably connected to the motor output shaft such that rotation of the motor output shaft causes the connecting rods to reciprocate axially in an asynchronous manner;

a rocker arm attached to the housing head portion at a pivot axis thereof, wherein the rocker arm is operably connected to the second ends of the connecting rods and is moved about the pivot axis by rotation of the motor output shaft;

at least two slideblocks connected to the rocker arm and movable along a linear path with respect to the rocker arm;

at least two spaced apart massage nodes, each being attached to one of the at least two slideblocks, the at least two massage nodes forming a massage surface, wherein the at least two massage nodes are moved toward and away from the massage head portion by each of the connecting rods to provide a percussive massage effect;

a cam rotatable with respect to the rocker arm and engaged with the at least two slideblocks such that rotation of the cam drives each slideblock along the linear path toward and away from a central region of the massage head portion;

an ancillary transmission having an output and an input, the transmission output being connected to the cam, and the transmission input being operably engageable with the motor output shaft; and an actuation member for selectively engaging and disengaging the transmission input with the motor output shaft;

wherein the ancillary transmission imparts a reduced rotation from the motor output shaft to the cam such that the cam drives the at least two slideblocks to progressively increase and decrease the spacing between the at least two massage nodes.

32. The percussive massager of claim 31, wherein a spring cooperates with the actuation member and the massage head portion for disengaging the transmission input from the motor output shaft allowing a user-applied force applied to the actuation member, to bias the spring such that the transmission input engages with the motor output shaft.

33. The percussive massager of claim 31, wherein the actuation member is actuated by a user to a first position wherein the transmission input is continuously engaged with the motor output shaft and the actuation member is actuated by the user to a second position wherein the transmission input is continuously disengaged with the motor output shaft.

34. The percussive massager of claim 31, wherein the transmission output is further defined as an external gear engaged with a face gear rotationally connected with the cam.

35. The percussive massager of claim 31, wherein the at least two massage nodes include resistors wired for conducting heat therethrough.

36. The percussive massager of claim 31, wherein the transmission input is further defined as a roller for rolling engagement with a crank arm rotationally driven by the motor output shaft.

37. The percussive massager of claim 36, wherein the ancillary transmission includes a reduction wheel rotationally driven by a belt interconnecting the roller and reduction wheel.

38. The percussive massager of claim 37, wherein the ancillary transmission includes a worm drive rotationally driven by the reduction wheel for imparting a further reduced rotation to a worm gear within the ancillary transmission.

39. A percussive massager comprising:

a housing;

a motor supported by the housing, having a rotatably driven output shaft;

a percussion arm movably connected to the housing and operably driven by the motor output shaft;

at least two slideblocks connected to the percussion arm and movable along a linear path with respect to the percussion arm;

at least two spaced apart massage nodes, each being attached to one of the at least two slideblocks, the at least two massage nodes forming a massage surface, wherein the at least two massage nodes are moved toward and away from the housing by operable connection to the motor output shaft to provide a percussive massage effect;

a cam rotatable with respect to the percussion arm and engaged with the at least two slideblocks such that rotation of the cam drives each slideblock along the linear path toward and away from a central region of the housing; and an adjustment mechanism rotationally cooperating with the cam and extending out of the housing such that manual adjustment thereof imparts rotation to the cam such that the cam drives the at least two slideblocks for adjusting the spacing between the at least two massage nodes.

40. The percussive massager of claim 39, wherein the motor output shaft protrudes from the motor on either side thereof; and further comprising:

a pair of connecting rods each having a first end and a second end, wherein the first ends are operably connected to the motor output shaft such that rotation of the motor output shaft causes the connecting rods to reciprocate axially in an asynchronous manner;

wherein the percussion arm is further defined as a rocker arm attached to the housing at a pivot axis thereof, wherein the rocker arm is operably connected to the second ends of the connecting rods and is moved about the pivot axis by rotation of the motor output shaft such that the at least two massage nodes are moved asynchronously toward and away from the housing by each of the connecting rods to provide the percussive massage effect.

41. The percussive massager of claim 39, wherein the at least two massage nodes include resistors wired for conducting heat therethrough.

42. The percussive massager of claim 39 further defined as a hand-held massager.

43. The percussive massager of claim 39, further defined as a non hand-held massager.

44. The percussive massager of claim 39, further defined as a cushion massager.

45. A foot massager comprising at least two spaced apart percussive massagers, each as specified in claim 39.

46. A percussive massager comprising:

a housing;

a first motor supported by the housing, having a rotatably driven output shaft;

a percussion arm movably connected to the housing and operably driven by the motor output shaft;

at least one positioning member;

at least two spaced apart massage nodes operably connected to the percussion arm, at least one of the at least two massage nodes being attached to the at least one positioning member, the at least two massage nodes forming a massage surface, wherein at least one of the at least two massage nodes is moved toward and away from the housing by operable connection to the motor output shaft to provide a percussive massage effect;

a rotary mechanism rotatable with respect to the percussion arm and engaged with the at least one positioning member such that rotation of the rotary mechanism drives a portion of the at least one positioning member toward and away from a central region of the housing;

an ancillary transmission having an output and an input, the transmission output being connected to the rotary mechanism; and a second motor supported by the housing and operably connected to the transmission input;

wherein selective rotation of the second motor transmits a selective rotation to the rotary mechanism for driving the portion of the at least one positioning member to vary the spacing between the at least two massage nodes.

47. The percussive massager of claim 46, wherein the motor output shaft protrudes from the first motor on either side thereof; and further comprising:

a pair of connecting rods each having a first end and a second end, wherein the first ends are operably connected to the motor output shaft such that rotation of the motor output shaft causes the connecting rods to reciprocate axially in an asynchronous manner;

wherein the percussion arm is further defined as a rocker arm attached to the housing at a pivot axis thereof, wherein the rocker arm is operably connected to the second ends of the connecting rods and is moved about the pivot axis by rotation of the motor output shaft such that the at least two massage nodes are moved asynchronously toward and away from the housing by each of the connecting rods to provide the percussive massage effect.

48. The percussive massager of claim 46, further comprising a torque sensor in cooperation with the second motor for signaling a torque level of the second motor that exceeds normal levels, corresponding to a limit in the movement of the at least one positioning member, such that the signal discontinues the operation of the second motor.

49. The percussive massager of claim 46, further comprising a current sensor in cooperation with the second motor for signaling a current level of the second motor that exceeds normal levels, corresponding to a limit in the movement of the at least one positioning member, such that the signal discontinues the operation of the second motor.

50. The percussive massager of claim 46, wherein the at least two massage nodes include resistors wired for conducting heat therethrough.

51. The percussive massager of claim 46, further defined as a hand-held massager.

52. The percussive massager of claim 46, further defined as a non hand-held massager.

53. The percussive massager of claim 46, further defined as a cushion massager.

54. The percussive massager of claim 46, further defined as a foot massager.

55. A foot massager comprising at least two spaced apart percussive massagers, each as specified in claim 46.

* * * * *